US012434102B1

(12) United States Patent
Kawamoto et al.

(10) Patent No.: US 12,434,102 B1
(45) Date of Patent: Oct. 7, 2025

(54) BALL LAUNCH ANALYSIS DEVICE AND BALL LAUNCH ANALYSIS METHOD

(71) Applicant: GPRO Co., Ltd., Amagasaki (JP)

(72) Inventors: Hideaki Kawamoto, Amagasaki (JP); Viet Manh Do, Hanoi (VN); Hong Quan Luong, Hanoi (VN)

(73) Assignee: GPRO Co., Ltd. (JP)

( * ) Notice: Subject to any disclaimer, the term of this patent is extended or adjusted under 35 U.S.C. 154(b) by 0 days.

(21) Appl. No.: 19/207,423

(22) Filed: May 14, 2025

(51) Int. Cl.
*A63B 24/00* (2006.01)
*A63B 102/32* (2015.01)

(52) U.S. Cl.
CPC .. *A63B 24/0021* (2013.01); *A63B 2024/0031* (2013.01); *A63B 2024/0034* (2013.01); *A63B 2102/32* (2015.10); *A63B 2220/806* (2013.01)

(58) Field of Classification Search
CPC ..... A63B 24/0021; A63B 2102/32; A63B 2024/0031; A63B 2024/0034
See application file for complete search history.

(56) References Cited

U.S. PATENT DOCUMENTS

| | | | | |
|---|---|---|---|---|
| 5,342,054 | A * | 8/1994 | Chang | A63B 24/0021 434/252 |
| 2005/0153785 | A1* | 7/2005 | Sun | A63B 24/0003 473/151 |
| 2011/0028248 | A1* | 2/2011 | Ueda | A63B 69/3632 473/409 |
| 2013/0137528 | A1* | 5/2013 | Ishii | A63B 37/0003 473/409 |
| 2016/0358425 | A1* | 12/2016 | Luciano | G07F 17/326 |
| 2017/0239521 | A1* | 8/2017 | Packard | A63B 63/00 |
| 2017/0257568 | A1* | 9/2017 | Kim | H04N 23/667 |
| 2018/0207508 | A1* | 7/2018 | Lee | A63B 69/0002 |
| 2019/0046837 | A1* | 2/2019 | Kawamoto | A63B 24/0021 |
| 2019/0358491 | A1* | 11/2019 | Kwon | A63B 24/0006 |

FOREIGN PATENT DOCUMENTS

| | | | |
|---|---|---|---|
| JP | 2000066315 | A | 3/2000 |
| JP | 2005529339 | A | 9/2005 |
| JP | 2012052845 | A | 3/2012 |
| JP | 2013153802 | A | 8/2013 |
| JP | 2015512660 | A | 4/2015 |

(Continued)

*Primary Examiner* — Eugene L Kim
*Assistant Examiner* — Christopher Glenn

(57) ABSTRACT

The placement determination control part 103 determines whether a ball was placed in a left trigger zone within the left detecting zone of the left capturing zone or a right trigger zone within the right detecting zone of the right capturing zone, using left and right cameras. The appearance determination control part 104 determines if an object appeared in a placement detecting zone, including a placement trigger zone, using the infrared sensor corresponding to the camera of that zone. The disappearance determination control part 105 determines if the ball disappeared from the placement detecting zone where the object appeared, using the corresponding infrared sensor. The next appearance determination control part 105 checks whether the ball appeared in a launch detecting zone, using the infrared sensor corresponding to the launch detecting zone adjacent to the placement detecting zone. The signal transmission control part 106 transmits a trigger signal accordingly.

20 Claims, 16 Drawing Sheets

(56) References Cited

FOREIGN PATENT DOCUMENTS

| | | | |
|---|---|---|---|
| JP | 2017169950 | A | 9/2017 |
| JP | 2018205074 | A | 12/2018 |
| JP | 2019536064 | A | 12/2019 |
| JP | 2020071228 | A | 5/2020 |
| JP | 2020078069 | A | 5/2020 |
| JP | 2020095019 | A | 6/2020 |
| JP | 2021507426 | A | 2/2021 |
| JP | 2021071387 | A | 5/2021 |
| JP | 2022520507 | A | 3/2022 |
| JP | 2022520681 | A | 4/2022 |
| JP | 2023548132 | A | 11/2023 |

* cited by examiner

BALL LAUNCH ANALYSIS DEVICE AND BALL LAUNCH ANALYSIS METHOD

TECHNICAL FIELD

The present invention relates to a ball launch analysis device and a ball launch analysis method.

Background Art

Conventionally, there are many techniques related to analysis devices for when a ball such as a golf ball is launched by a club. For example, Japanese Unexamined Patent Application Publication (Translation of PCT Application) No. 2005-529339 (Patent Document 1) discloses a method for determining parameters of a moving golf ball. Japanese Unexamined Patent Application Publication (Translation of PCT Application) No. 2015-512660 (Patent Document 2) discloses a device for measuring a golf club head having a club face. Japanese Unexamined Patent Application Publication (Translation of PCT Application) No. 2019-536064 (Patent Document 3) discloses a golf ball launch monitor used with an alignment stick. Japanese Unexamined Patent Application Publication No. 2020-071228 (Patent Document 4) discloses a method for calculating a motion trajectory of a subject. Japanese Unexamined Patent Application Publication No. 2020-078069 (Patent Document 5) discloses a method for supporting the filming of a golf swing. Japanese Unexamined Patent Application Publication No. 2020-095019 (Patent Document 6) discloses a method for measuring a rotation of a ball. Japanese Unexamined Patent Application Publication (Translation of PCT Application) No. 2021-507426 (Patent Document 7) discloses a ball tracking system that includes a display, a sensor, a launch monitor, and a processor. Japanese Unexamined Patent Application Publication (Translation of PCT Application) No. 2022-520507 (Patent Document 8) discloses a method for measuring physical quantities related to a golf club. Japanese Unexamined Patent Application Publication (Translation of PCT Application) No. 2022-520681 (Patent Document 9) discloses a method for measuring ball rotation. Japanese Unexamined Patent Application Publication (Translation of PCT Application) No. 2023-548132 (Patent Document 10) discloses a method for supporting a virtual golf simulation.

Japanese Unexamined Patent Application Publication No. 2000-66315 (Patent Document 11) discloses a method capable of scientifically measuring a behavior of a club having a deep causal relationship with a motion of a launch ball. Japanese Unexamined Patent Application Publication No. 2013-153802 (Patent Document 12) discloses a measuring apparatus for a golf club, which reduces measurement errors and has high convenience. Japanese Unexamined Patent Application Publication No. 2012-52845 (Patent Document 13) discloses a measuring device to measure speeds of both a hitting tool and an object to be hit more accurately.

On the other hand, the present applicant has filed applications for and obtained JP and US patents to the inventions shown in the following patent documents. For example, Japanese Unexamined Patent Application Publication No. 2017-169950 (Patent Document 14) discloses a flying ball detection device and a flying ball detection method for detecting flying balls. Japanese Unexamined Patent Application Publication No. 2018-205074 (Patent Document 15) discloses a flight parameter measurement device and a flight parameter measurement method. Japanese Unexamined Patent Application Publication No. 2021-071387 (Patent Document 16) discloses a ball tracking device and a ball tracking method.

CITATION LIST

Patent Literature

[PTL1] Japanese Unexamined Patent Application Publication (Translation of PCT Application) No. 2005-529339

[PTL2] Japanese Unexamined Patent Application Publication (Translation of PCT Application) No. 2015-512660

[PTL3] Japanese Unexamined Patent Application Publication (Translation of PCT Application) No. 2019-536064

[PTL4] Japanese Unexamined Patent Application Publication No. 2020-071228

[PTL5] Japanese Unexamined Patent Application Publication No. 2020-078069

[PTL6] Japanese Unexamined Patent Application Publication No. 2020-095019

[PTL7] Japanese Unexamined Patent Application Publication (Translation of PCT Application) No. 2021-507426

[PTL8] Japanese Unexamined Patent Application Publication (Translation of PCT Application) No. 2022-520507

[PTL9] Japanese Unexamined Patent Application Publication (Translation of PCT Application) No. 2022-520681

[PTL10] Japanese Unexamined Patent Application Publication (Translation of PCT Application) No. 2023-548132

[PTL11] Japanese Unexamined Patent Application Publication No. 2000-66315

[PTL12] Japanese Unexamined Patent Application Publication No. 2013-153802

[PTL13] Japanese Unexamined Patent Application Publication No. 2012-52845

[PTL14] Japanese Unexamined Patent Application Publication No. 2017-169950

[PTL15] Japanese Unexamined Patent Application Publication No. 2028-205074

[PTL16] Japanese Unexamined Patent Application Publication No. 2021-071387

SUMMARY OF INVENTION

Technical Problem

In recent years, sensors such as infrared sensors and cameras have become easily available, and progresses are being made in a development of devices that use these sensors to perform with high accuracy from a player's ball launch to an analysis of flight parameters of the ball.

Although the infrared sensor can detect an appearance of a club and a disappearance of the ball with high accuracy when the ball is launched, it has a problem that it is weak against external noise and false detection is likely to occur. Although the camera can accurately capture a placement position of the ball with its wide viewing angle, in order to capture a moment when the ball is launched, it is necessary to continuously capture with the camera at all times after the ball was placed. In order to properly capture the moment, it is necessary to use a high-performance camera that allows high-speed continuous capturing, it is costly. In addition, the continuous capturing with a camera requires a huge data capacity, and in reality, it is sufficient that the camera continuously captures the moment, but in order to capture the moment, the camera needs to continuously capture scene even when the player is practicing, it is a problem that it is an inefficient.

The techniques described in the above Patent Documents 1 to 12, 15 to 16 use a camera and have the same problems as those described above. Also, the above Patent Document 14 uses infrared sensors and has the same problems as those described above. Here, the above Patent Document 13 uses a doppler sensor, but similarly, the doppler sensor needs to continuously monitor scene even when the player is practicing, it is the same problem.

Therefore, the present invention has been made to solve the above-mentioned problems, and aims to provide a ball launch analysis device and a ball launch analysis method that are capable of performing with high accuracy from a launch of a ball to an analysis of flight parameters of the ball by appropriately combining infrared sensors and cameras.

Solution to Problem

A ball launch analysis device in the present invention comprises left and right infrared sensors, left and right cameras, a placement determination control part, an appearance determination control part, a disappearance determination control part, a next appearance determination control part, a signal transmission control part, a capture control part, and a calculation control part. The left and right infrared sensors are provided on left and right sides of the device respectively, and are capable of detecting a left detecting zone and a right detecting zone respectively, wherein the left detecting zone and the right detecting zone are adjacent to each other and do not overlap. The left and right cameras are provided on the left and right sides of the device respectively, and are capable of capturing a left capturing zone and a right capturing zone including the left detecting zone and the right detecting zone respectively, wherein the left capturing zone and the right capturing zone overlap each other. The placement determination control part determines whether or not a ball was placed in either a left trigger zone that is preset within the left detecting zone in the left capturing zone or a right trigger zone that is preset within the right detecting zone in the right capturing zone by using the left and right cameras. The appearance determination control part determines whether or not an object appeared in a placement detecting zone including a placement trigger zone by using the infrared sensor corresponding to the camera of the placement trigger zone where the ball was placed when it is determined that the ball was placed in either the left trigger zone or the right trigger zone by the placement determination control part. The disappearance determination control part determines whether or not the ball disappeared from the placement detecting zone where the object appeared by using the infrared sensor corresponding to the placement detecting zone when it is determined that the object appeared in the placement detecting zone by the appearance determination control part. The next appearance determination control part determines whether or not the ball appeared in a launch detecting zone by using the infrared sensor corresponding to the launch detecting zone adjacent to the placement detecting zone when it is determined that the ball disappeared from the placement detecting zone by the disappearance determination control part. The signal transmission control part transmits a trigger signal when it is determined that the ball appeared in the launch detecting zone by the next appearance determination control part. The capture control part captures the ball continuously in the left capturing zone and the right capturing zone by using the left and right cameras when the trigger signal is transmitted. And the calculation control part calculates flight parameters of the ball based on ball images of the ball continuously captured by the left and right cameras.

A ball launch analysis method in the present invention comprises the left and right infrared sensors, the left and right cameras, a placement determination control step, an appearance determination control step, a disappearance determination control step, a next appearance determination control step, a signal transmission control step, a capture control step, and a calculation control step, and each control step corresponds to each control part of the ball launch analysis device in the present invention.

Advantageous Effects of the Invention

According to the present invention, it is possible to perform with high accuracy from a launch of a ball to an analysis of flight parameters of the ball by appropriately combining infrared sensors and cameras.

DESCRIPTION OF EMBODIMENTS

The preferred embodiments of the present invention will be explained below according to the attached drawings; thereby the present invention will be clearly understood.

The embodiments below are examples materializing the present invention, and do not limit the technical scope of the present invention.

Figure 1B:
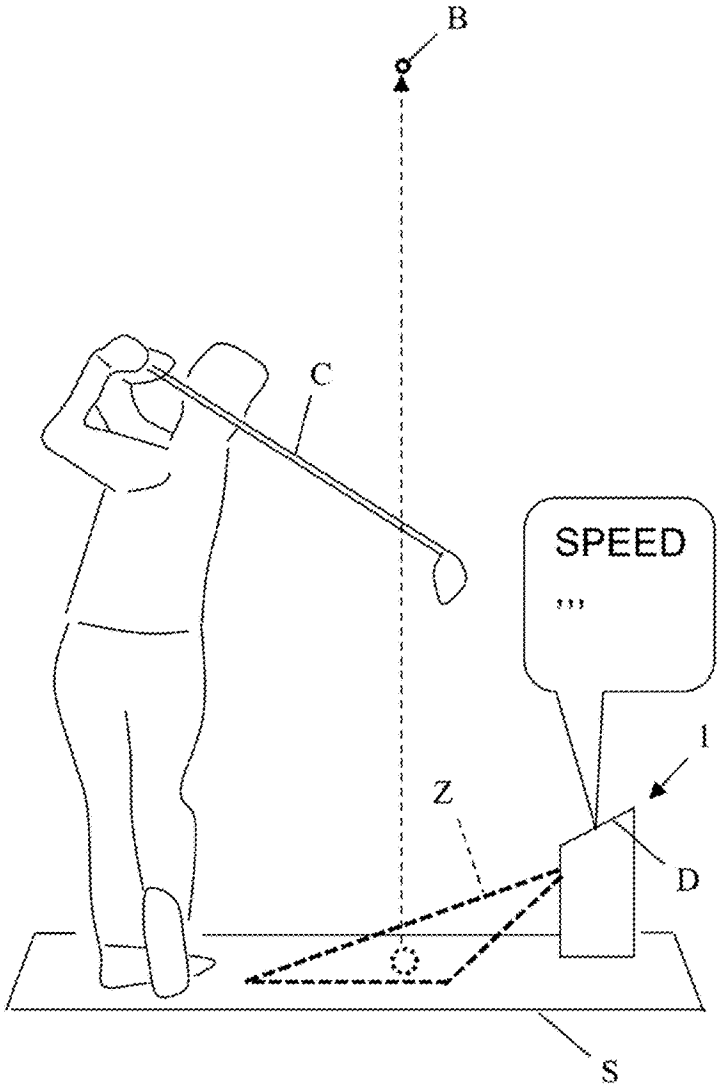
FIG. 1B is a schematic view indicating an example when the player swinged by using the ball launch analysis device according to the present invention.
Figure 1A:
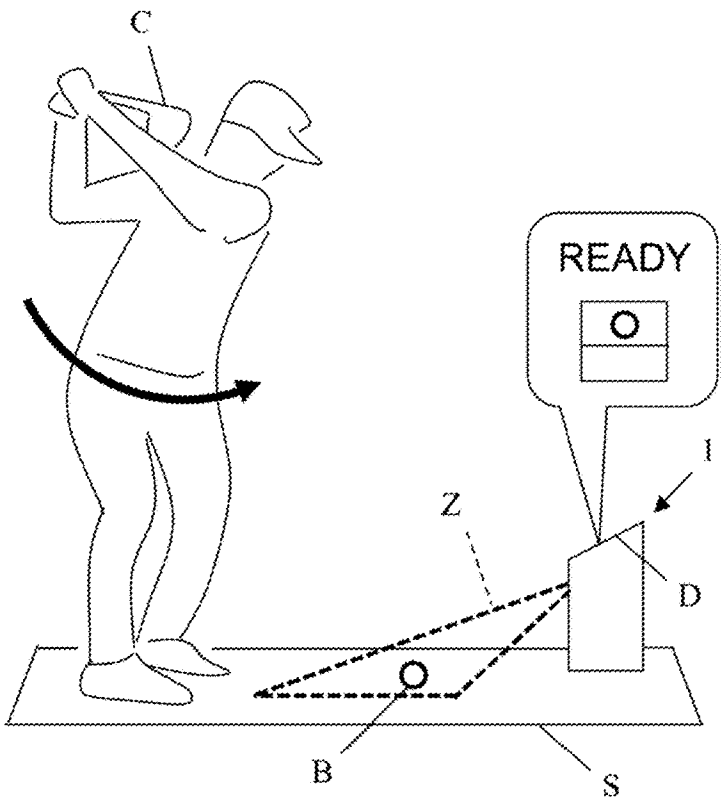
FIG. 1A is a schematic view indicating an example when a player swings by using the ball launch analysis device according to the present invention.

As shown in FIG. 1A, the ball launch analysis device 1 according to the present invention is installed on a flat tee ground S, activates left and right infrared sensors and the left and right cameras in response to turning on the power, and the device 1 comprises each zone Z (detecting zone, capturing zone). When a player P (user) places ball B (e.g., a golf ball) in zone Z, the ball launch analysis device 1 determines whether ball B was placed in a predetermined trigger zone in the zone Z.

When ball B was placed in the trigger zone, the ball launch analysis device 1 displays a message indicating a preparation (e.g., "READY") on a display part D (monitor), or displays ball images of ball B captured by the left and right cameras.

As shown in FIG. 1B, when the player P launches the ball B with club C, the ball launch analysis device 1 detects in the zone Z from an appearance of the club C to a disappearance of the ball B, and transmits a trigger signal indicating that ball B is launched.

The ball launch analysis device 1 analyzes the ball images of the ball B captured by the left and right cameras in response to transmit the trigger signal, calculates flight parameters of the ball B (e.g., carry, ball speed, launch angle, side angle, backspin, side spin, etc.) and displays the calculated flight parameters on the display part D.

Figure 2:
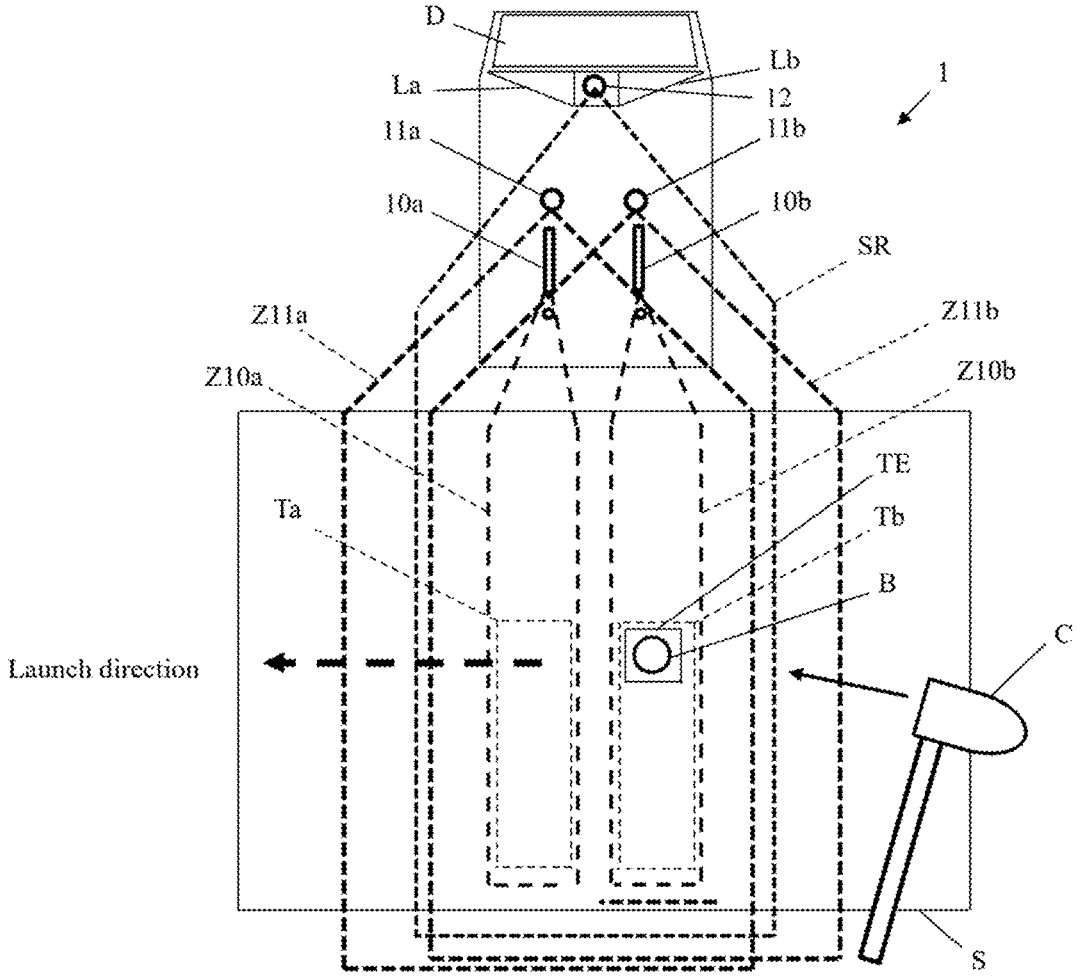
FIG. 2 is a schematic view indicating an example of a specific configuration of a ball launch analysis device according to the present invention.
Figure 3:
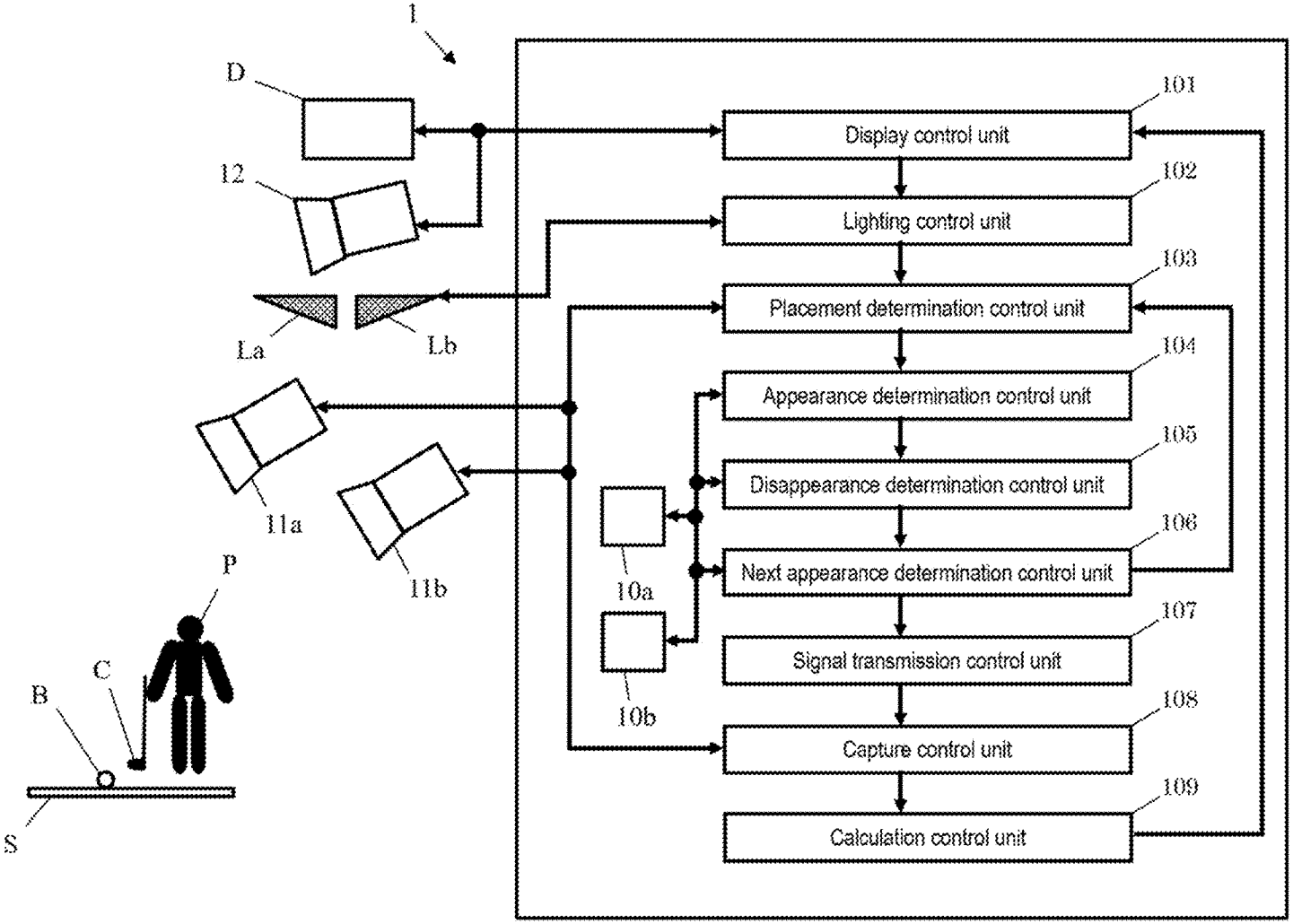
FIG. 3 is a functional block diagram of the ball launch analysis device according to the present invention.

The specific configuration of the ball launch analysis device 1 will be explained. As shown in FIG. 2, the ball launch analysis device 1 includes the left and right infrared sensors (a left infrared sensor 10*a* and a right infrared sensor 10*b*) and the left and right cameras (a left camera 11*a* and a right camera 11*b*).

The left and right infrared sensors 10*a*, 10*b* are provided on left and right sides of the device 1 respectively, and are capable of detecting a left detecting zone Z10*a* and a right detecting zone Z10*b* respectively, and the left detecting zone Z10*a* and the right detecting zone Z10*b* are adjacent to each other and do not overlap. As shown in FIG. 2, the left infrared sensor 10*a* is installed on a lower left side of the device 1, and the right infrared sensor 10*b* is installed on a lower right side of the device 1. The left detecting zone Z10*a* of the left infrared sensor 10*a* and the right detecting zone Z10*b* of the right infrared sensor 10*b* are configured in a predetermined shape (e.g., a rectangular shape), they are adjacent to each other and do not overlap. The left and right infrared sensors 10*a*, 10*b* detect an appearance of the ball B in either the right detecting zone Z10*a* or the left detecting zone Z10*b*, an appearance of the club C (an object), and a disappearance of the ball B based on changes in intensity of reflected light in the right detecting zone Z10*a* and the left detecting zone Z10*b* respectively.

The configuration of the left and right infrared sensors 10*a*, 10*b* is not particularly limited. For example, as shown in FIG. 2, rectangular slits are provided on the left and right sides of the ball launch analysis device 1, LEDs (light-emitting elements) that use infrared light as light sources are provided inside the left and right slits, infrared light emitted by the LEDs passes through the slits of a predetermined shape (e.g., rectangular shape) respectively, and comprise the left detecting zone Z10*a* and the right detecting zone Z10*b* in the shape (e.g., rectangular shape). In this way, by providing the slits on the left and right, the left detecting zone Z10*a* and the right detecting zone Z10*b* form the predetermined shape as a whole, and comprise the detecting zone Z on the at the tee ground S.

A width of a launch direction of the left detecting zone Z10*a* and the right detecting zone Z10*b* are set appropriately. For example, when the ball B was placed in the left detecting zone Z10*a* or the right detecting zone Z10*b*, the width of the launch direction of the left detecting zone Z10*a* and the right detecting zone Z10*b* are set so that the ball B is present only in either the left detecting zone Z10*a* or the right detecting zone Z10*b*.

The ball launch analysis device 1 provides holes directly below the left and right slits, photodiodes (light receiving elements) that receive reflected infrared light are provided inside the holes, and the photodiodes detect the intensity of the reflected light in the left detecting zone Z10*a* and the right detecting zone Z10*b*. When the ball B was placed in either the left detecting zone Z10*a* or the right detecting zone Z10*b*, the ball launch analysis device 1 proceeds in an infrared detection state, and the photodiodes detect the intensity of the reflected light in the left detecting zone Z10*a* and the right detecting zone Z10*b* through the holes.

The left and right cameras 11*a*, 11*b* are provided on the left and right sides of the device 1 respectively. The left camera 11*a* is installed on an upper left side of the device 1, and the right camera 11*b* is installed on an upper right side of the device 1. The left and right cameras 11*a*, 11*b* are capable of capturing left a capturing zone Z11*a* and a right capturing zone Z11*b* including the left detecting zone Z10*a* and the right detecting zone Z10*b* respectively, and the left capturing zone Z11*a* and the right capturing zone Z11*b* overlap each other. Here, since the left and right cameras 11*a*, 11*b* have a certain viewing angle, the left capturing zone Z11*a* of the left camera 11*a* includes the left detecting zone Z10*a* and the right detecting zone Z10*b*, and the left capturing zone Z11*b* of the right camera 11*b* includes the left detecting zone Z10*a* and the right detecting zone Z10*b*. For example, the viewing angles of the left and right cameras 11*a*, 11*b* are triangular, so that the left capturing zone Z11*a* of the left camera 11*a* and the right capturing zone Z11*b* of the right camera 11*b* include the left detecting zone Z10*a* and the right detecting zone Z10*b* in common and partially overlap.

As shown in FIG. 2, when the player P launches the ball B from right to left with respect to the ball launch analysis device 1, the front of the launch direction of the tee ground S is the left, and the rear of the launch direction of the tee ground S is the right. In this case, the left infrared sensor 10*a* and the left camera 11*a* first detect and capture the launch of the player P, and the right infrared sensor 10*b* and the right camera 11*b* later detect and capture the launch of the player P. On the other hand, when the player P launches the ball B from left to right with respect to the ball launch analysis device 1, the front of the launch direction of the tee ground S is the right, and the rear of the launch direction of the tee ground S is the left. In this case, the right infrared sensor 10*b* and the right camera 11*b* first detect and capture the launch of the player P, and the left infrared sensor 10*a* and the left camera 11*a* later detect and capture the launch of the player P.

By the way, a left trigger zone Ta where the ball B was placed in the left detecting zone Z10*a* of the left infrared sensor 10*a* is preset within the left capturing zone Z11*a* of the left camera 11*a*, and a right trigger zone Tb where the ball B was placed in the right detecting zone Z10*b* of the right infrared sensor 10*b* is preset within the right capturing zone Z11*a* of the right camera 11*b*. The ball launch analysis device 1 determines whether the ball B was placed in either the left trigger zone Ta or the right trigger zone Tb.

A tee zone TE where the ball B can be placed is provided in advance at the tee ground S, and the ball launch analysis device 1 is installed by an operation of the player P so that either the left trigger zone Ta or the right trigger zone Tb overlaps with the tee zone TE of the tee ground S. As shown in FIG. 2, for example, the ball launch analysis device 1 is installed so that the right trigger zone Tb of the right capturing zone Z11*b* of the right camera 11*b* overlaps with the tee zone TE.

On the other hand, a swing camera 12 is installed in the ball launch analysis device 1 near the upper center of the ball launch analysis device 1, and the swing camera 12 captures a swing zone SR that overlaps a left capturing zone Z11*a* of the left camera 11*a* and a right capturing zone Z11*b* of the right camera 11*a*. In this way, it is possible to capture swing of the player P.

In addition, left and right lights La, Lb that can light in a variety of colors are installed on the left and right above the ball launch analysis device 1. A monitor D which can display various messages, ball images, analysis results, etc. is installed above the ball launch analysis device 1.

The ball launch analysis device 1 includes a power supply part, a control part, and a communication part, and the power supply part supplies power to each part, the left and right infrared sensors 10*a*, 10*b*, the left and right cameras 11*a*, 11*b*, the swing camera 12, the left and right lights La, Lb, the monitor D, etc. The control part includes, for example, a CPU, a ROM, a RAM, etc., not shown in the drawing, and the CPU uses, for example, the RAM as a working zone to execute a program stored in the ROM, etc. Also, each control parts described below are realized by the CPU executing a program. The communication part communicates with a terminal device or a mobile terminal device of the player P, transmits analysis results of the ball launch analysis device 1, and receives information from the terminal device or the mobile terminal device of the player P.

As referring to FIG. 3 to 14, configurations and execution steps in an embodiment of the present invention are explained. First, when a player P turns on the power of the ball launch analysis device 1 (FIG. 4: S101), the ball launch analysis device 1 executes predetermined processes, and a display control part 101 of the ball launch analysis device 1 activates the left and right cameras 11*a*, 11*b* (FIG. 4: S102). Specifically, as shown in FIG. 5A, the display control part 101 enables the left camera 11*a* to capture the left capturing zone Z11*a*, and enables the right camera 11*b* to capture the right capturing zone Z11*b*.

Figure 4:
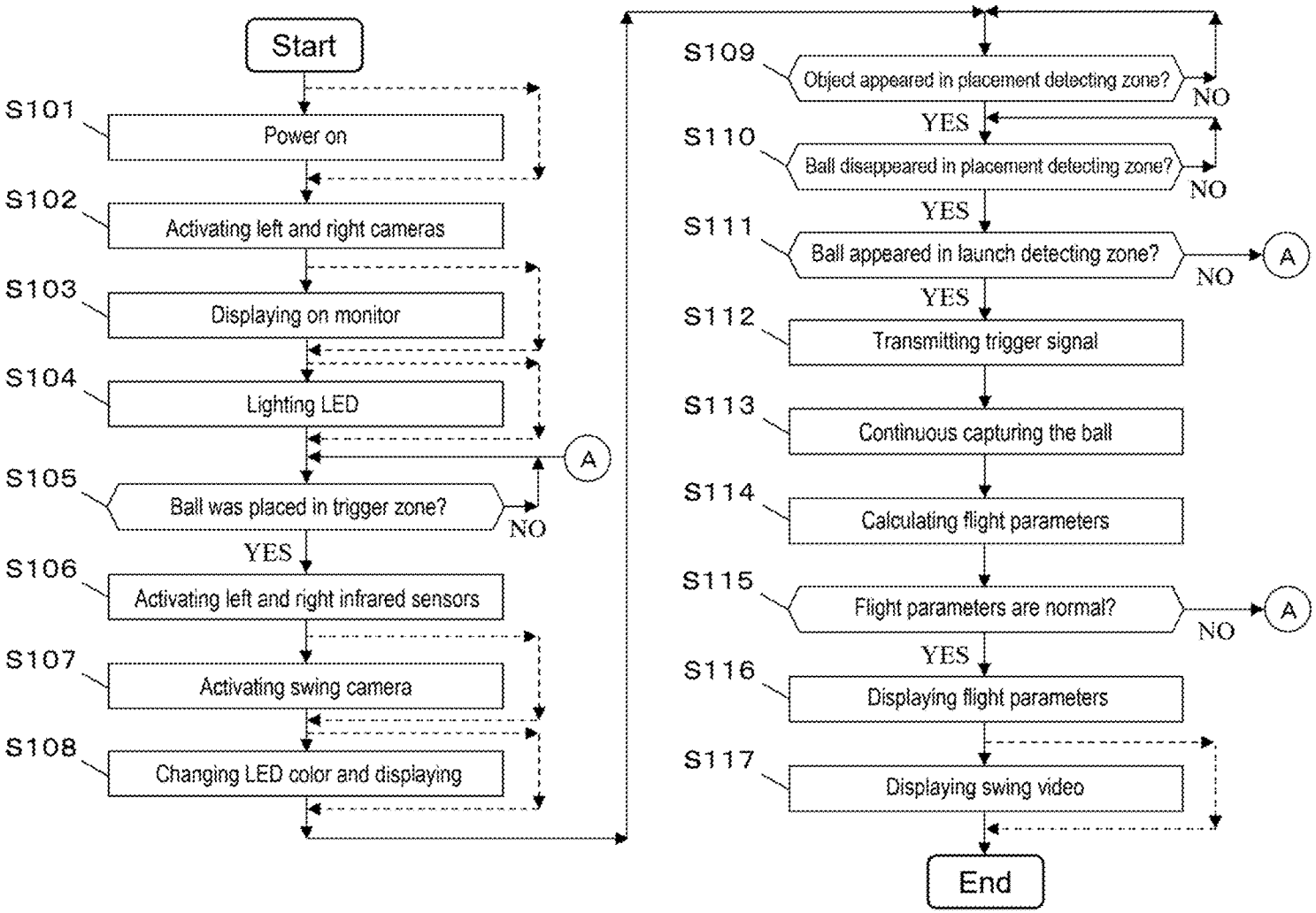
FIG. 4 is a flowchart indicating executive steps of the ball launch analysis device according to the present invention.
Figure 5B:
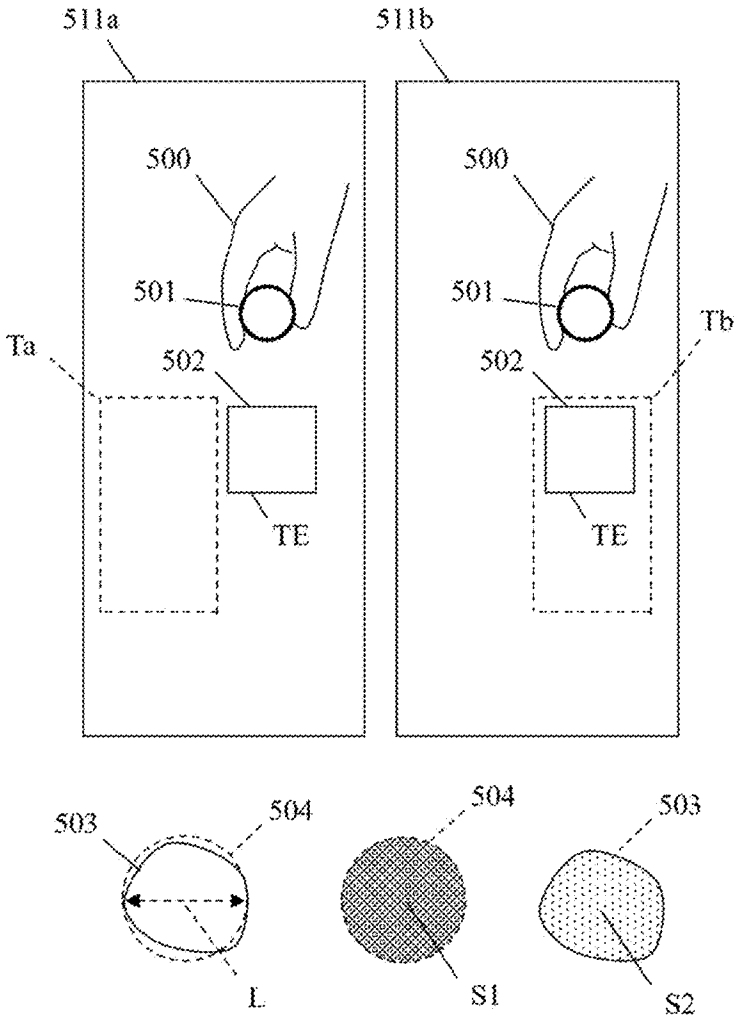
FIG. 5B is a drawing indicating an example when a ball image is specified from a left captured image and a right captured image captured by the left and right cameras.
Figure 5A:
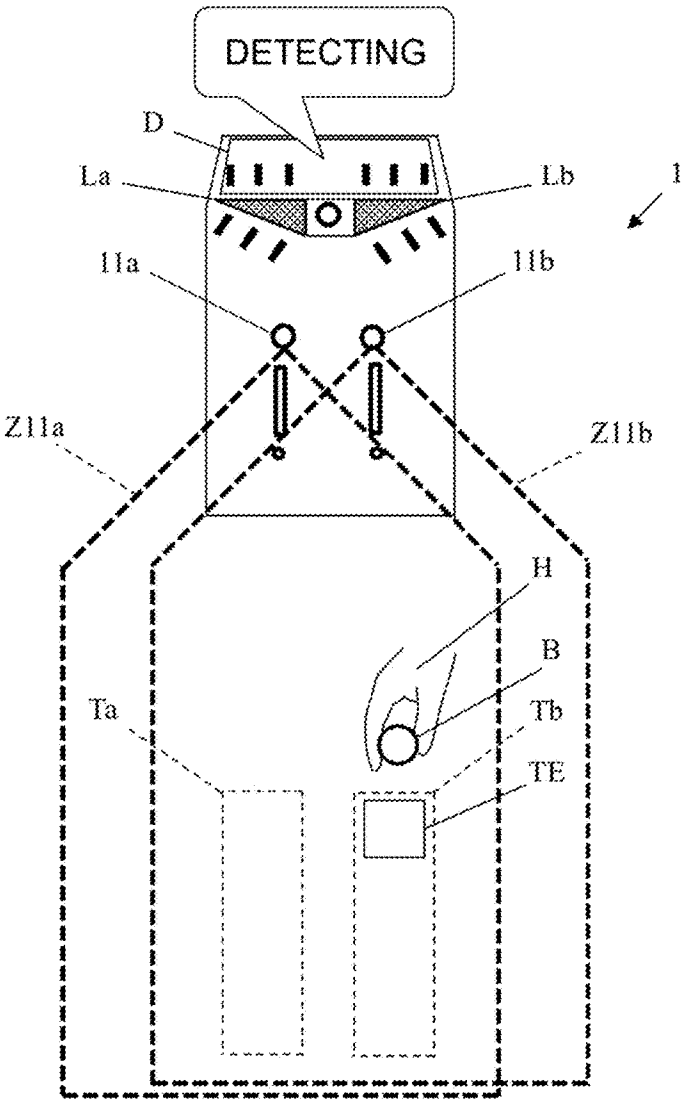
FIG. 5A is a schematic view indicating an example when left and right cameras of the ball launch analysis device according to the present invention are activated.

Next, the display control part 101 starts a display on the monitor D (FIG. 4: S103). Specifically, as shown in FIG. 5A, the display control part 101 displays a message indicating a detection status (e.g., "DETECTING") on the monitor D. In this way, it is possible to inform the player P of the detection status. In addition, at this time, when there is no information to be displayed on the monitor D or the monitor D is not installed, the display control part 101 may omit the display of S103.

Next, a lighting control part 102 of the ball launch analysis device 1 starts lighting the left and right lights La, Lb (FIG. 4: S104). Specifically, as shown in FIG. 5A, the lighting control part 102 lights the left and right lights La, Lb in a color (e.g., red) that indicates the detection state. In this way, it is possible to inform the player P of the detection state. In addition, when the left and right lights La, Lb are not installed, the lighting control part 102 may omit the display of S104.

When the display control part 101 activated the left and right cameras 11*a*, 11*b*, next, a placement determination control part 103 of the ball launch analysis device 1 determines whether or not the ball B was placed in either a left trigger zone Ta that is preset within the left detecting zone Z10*a* of the left capturing zone Z11*a* or a right trigger zone Tb that is preset within the right detecting zone Z10*b* of the right capturing zone Z11*b* by using the left and right cameras 11*a*, 11*b* (FIG. 4: S105).

The determination method of the placement determination control part 103 is not particularly limited. For example, as shown in FIG. 5B, when the placement determination control part 103 acquires a captured image 511*a* of the left capturing zone Z11*a* captured by the left camera 11*a* and a captured image 511*b* of the right capturing zone Z11*b* captured by the right camera 11*b*, the placement determination control part 103 searches whether or not there is a ball image corresponding to the ball B as a circular image in the captured image 511*a* of the left capturing zone Z11*a* or the captured image 511*b* of the right capturing zone Z11*b*.

The search method of the placement determination control part 103 is not particularly limited. For example, the placement determination control part 103 performs a predetermined image processing (for example, binarization processing) on the captured image 511*a* of the left capturing zone Z11*a* and the captured image 511*b* of the right capturing zone Z11*b*, and extracts an outer edge (contour) of an object in the captured image 511*a* of the left capturing zone Z11*a* and an outer edge of an object in the captured image 511*b* of the right capturing zone Z11*b*. Here, the binarization processing means a converting process that pixels comprising the captured images 511*a*, 511*b* whose pixel values are equal to or greater than a predetermined threshold are converted to "1" (white), and pixels whose pixel values are less than the threshold are converted to "0" (black). The threshold value is preset so that the outer edge of the ball B in the captured images 511*a*, 511*b* is clear.

Then, the placement determination control part 103 detects an image surrounded by the outer edge as an object image from the outer edge of the extracted object. For example, as shown in FIG. 5A, when the player P holds the ball B with his right hand H and tries to place the ball B in the tee zone TE, as shown in FIG. 5B, the outer edge of the right hand H, the outer edge of the ball B, and the outer edge of the tee zone TE are extracted from the captured image 511*a* of the left capturing zone Z11*a*, and a right hand image 500 surrounded by the outer edge of the right hand H, a ball image 501 surrounded by the outer edge of the ball B, and a tee image 502 surrounded by the outer edge of the tee zone TE are extracted. Since the right capturing zone Z11*b* is partially common to the left capturing zone Z11*a*, the right hand image 500, the ball image 501, and the tee image 502 are extracted from the captured image 511*b* of the right capturing zone Z11*b*.

The placement determination control part 103 specifies a circular image close to a circle for the detected object image. The specifying method of the circular image of the placement determination control part 103 is not particularly limited. For example, the placement determination control part 103 calculates a long side L of the object image 503, calculates an area S1 of a circle 504 having the calculated long side L as a diameter of the circle, and calculates an area S2 within the outer edge of the object image 503. Then, the placement determination control part 103 calculates an area ratio S1/S2 by dividing the area S1 of the circle 504 by the area S2 within the outer edge of the object image 503. The placement determination control part 103 calculates the area ratio S1/S2 for all object images 503, and specifies one object image 503 having the area ratio S1/S2 closest to 1 (–) among the area ratios S1/S2 of all object images 503 as a ball image. For example, as shown in FIG. 5B, the area ratio S1/S2 of the right hand image 500 is greater than 1, the area ratio S1/S2 of the tee image 502 is slightly closer to 1, and the area ratio S1/S2 of the ball image 501 is closest to 1, so that the ball image 501 is specified as a circular image. When the ball image 501 is specified as a circular image, the placement determination control part 103 searches the ball image 501 as a circular image. On the other hand, when no image whose the area ratio S1/S2 is closest to 1 is specified as a circular image, the placement determination control part 103 can not search the ball image as a circular image.

When the placement determination control part 103 can not search the ball image as a circular image, the placement determination control part 103 determines that the ball B was not placed in either the left trigger zone Ta of the left capturing zone Z11*a* or the right trigger zone Tb of the right capturing zone Z11*b* (FIG. 4: S105 NO). In this case, the placement determination control part 103 returns to S105 and repeats the determination of whether the ball B was placed.

On the other hand, when the placement determination control part 103 can search the ball image 501 as a circular image, the placement determination control part 103 acquires position information of the trigger zone of the capturing zone where the ball image 501 of the circular image is searched, and determines whether or not the searched ball image 501 is included inside the trigger zone. Here, as shown in FIG. 5B, when the ball image 501 is searched as a circular image in the captured image 511*a* of the left capturing zone Z11*a*, the placement determination control part 103 acquires position information of the left trigger zone Ta of the left capturing zone Z11*a* (for example, coordinates in the camera coordinate system indicating a boundary of the left trigger zone Ta), and determines whether or not the ball image 501 is included inside the left trigger zone Ta based on a positional relationship between the ball image 501 and the left trigger zone Ta. Similarly, when a ball image 501 is searched in the right capturing zone Z11*b*, the placement determination control part 103 acquires position information (coordinates in the camera coordinate system indicating a boundary of the right trigger zone Tb) of the right capturing zone Z11*b*, and determines whether the ball image 501 is included inside the right trigger zone Tb based on a positional relationship between the ball image 501 and the right trigger zone Tb.

As a result of the determination, when the ball image is not included inside the trigger zone as shown in FIG. 5B, the ball image 501 exists outside the left trigger zone Ta in the captured image 511*a* of the left capturing zone Z11*a*, the ball image 501 exists outside the right trigger zone Tb in the captured image 511*b* of the right capturing zone Z11*b*, the placement determination control part 103 determines that the ball B was not placed in either the left trigger zone Ta of the left capturing zone Z11*a* or the right trigger zone Tb of the right capturing zone Z11*b* (FIG. 4: S105 NO). In this case, the placement determination control part 103 returns to S105 and repeats the determination of the placement of the ball B again. Here, the placement determination control part 103 may display a message (for example, "Out of zone") indicating that the ball B is outside the detection range on the monitor D to prompt the player P to place the ball B in an appropriate position.

Figure 6B:
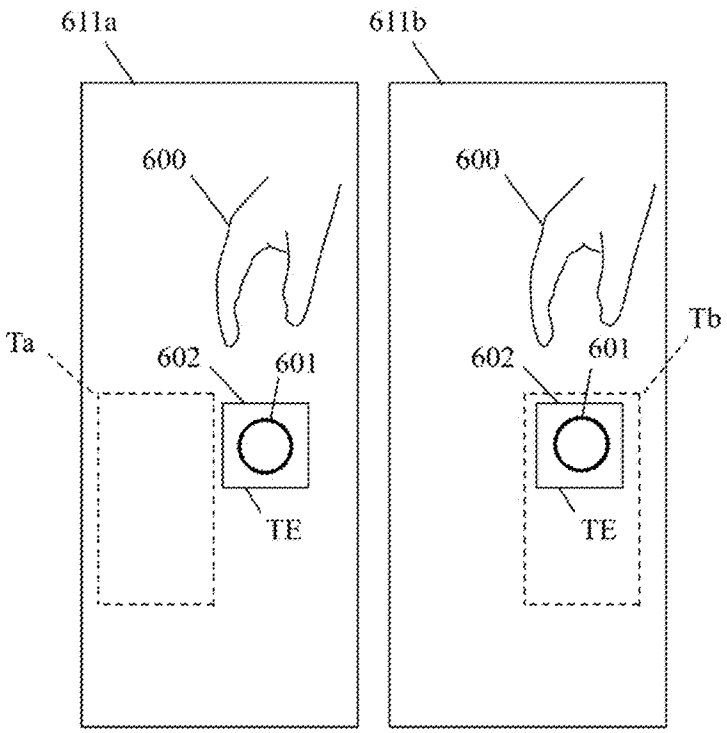
FIG. 6B is a diagram indicating an example when a ball image entered the right trigger zone in the right captured image.
Figure 6A:
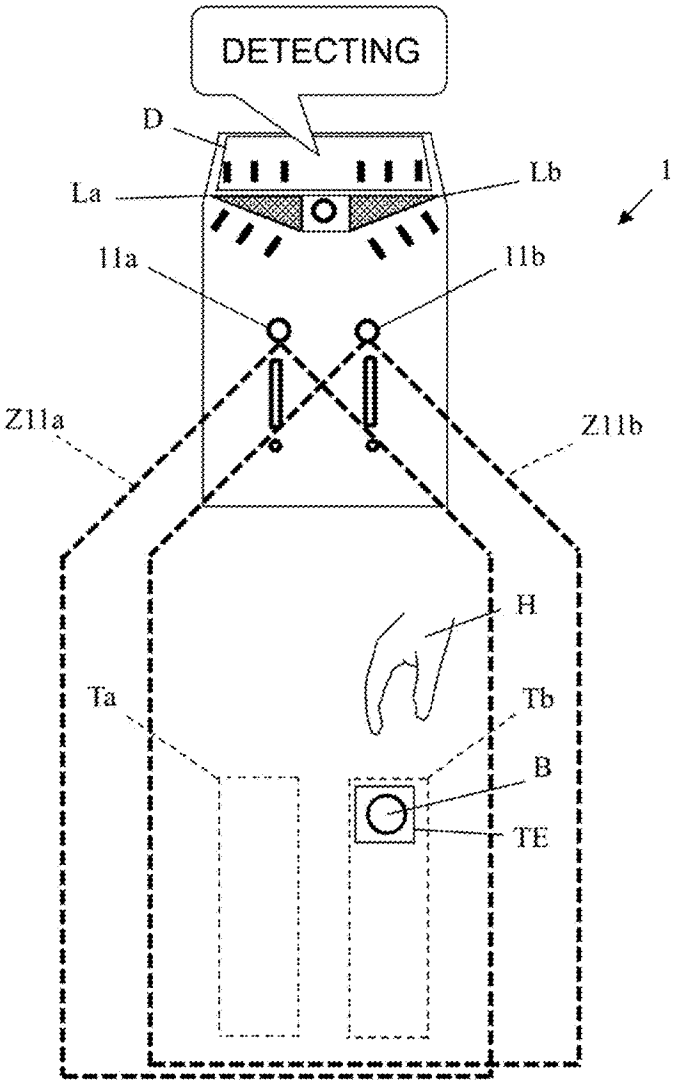
FIG. 6A is a schematic view indicating an example when a player placed a ball in a tee zone with the ball launch analysis device according to the present invention.

On the other hand, as shown in FIG. 6A, when the player P places the ball B in the tee zone TE and releases the ball B, as shown in FIG. 6B, the placement determination control part 103 performs the image processing on the captured image 611*a* of the left capturing zone Z11*a* and the captured image 611*b* of the right capturing zone Z11*b*, and extracts the outer edge of the object in the captured image 611*a* of the left capturing zone Z11*a* and the outer edge of the object in the captured image 611*b* of the right capturing zone Z11*b*. Next, the placement determination control part 103 detects an image surrounded by the outer edge as the object image from the outer edge of the extracted object, and a right hand image 600, a ball image 601, and a tee image 602 in the captured image 611*a* of the left capturing zone Z11*a* and the captured image 611*b* of the right capturing zone Z11*b* are extracted. When the placement determination control part 103 specifies and searches a circular image close to a circle for the detected object image, the ball image 601 is searched as a circular image in each of the captured image 611*a* of the left capturing zone Z11*a* and the captured image 611*b* of the right capturing zone Z11*b*. The placement determination control part 103 acquires position information of the left trigger zone Ta of the left capturing zone Z11*a* where the ball image 601 of the circular image is searched, and determines whether or not the ball image 601 searched in the left capturing zone Z11*a* is included inside the left trigger zone Ta. The placement determination control part 103 acquires position information of the right trigger zone Tb of the right capturing zone Z11*b*, and determines whether or not the ball image 601 specified in the right capturing zone Z11*b* is included inside the right trigger zone Tb.

As a result of the determination, as shown in FIG. 6B, when the ball image 601 is included inside the trigger zone Tb, specifically when the ball image 600 in the left capturing zone Z11*a* is not included inside the left trigger zone Ta, but the ball image 601 in the right capturing zone Z11*b* is included inside the right trigger zone Tb, the placement determination control part 103 determines that the ball B was placed in either the left trigger zone Ta in the left capturing zone Z11*a* or the right trigger zone Tb in the right capturing zone Z11*b* (FIG. 4: S105 YES). In this way, it is possible to determine the placement of the ball B with high accuracy.

For example, when the placement of ball B is determined by using only infrared sensors, the hand of the player P and club C may become noise, even though ball B was not placed, there were cases where it was falsely detected that ball B was placed. Also, even though ball B was not placed at a desired position, the infrared sensors may erroneously detect that ball B was placed. In the present invention, by analyzing the captured images by the left and right cameras 11*a*, 11*b*, it is possible to determine the placement of the ball B with high accuracy without causing erroneous detection.

And, the present invention provides a trigger zone in the captured image, and when the specified ball image is included inside the trigger zone, the present invention determines that ball B was placed. In other words, by using the positional relationship between the trigger zone and ball B, the present invention determines that ball B was placed only when ball B entered the trigger zone. Since the trigger zone is a zone that can be reliably detected by the left and right infrared sensors 10*a*, 10*b*, it is possible to have the player P accurately place the ball B in the trigger zone that can be reliably detected by the left and right infrared sensors 10*a*, 10*b*.

By the way, the placement determination control part 103 determines whether or not the ball B was placed in either the left trigger zone Ta of the left capturing zone Z11*a* or the right trigger zone Tb of the right capturing zone Z11*b*. However, the present invention is not limited to this. For example, the placement determination control part 103 may determine whether or not the ball B was placed in the trigger zone of the capturing zone by using one of the left and right cameras 11*a*, 11*b* that is preset by the player P. For example, when information on a dominant hand (right-handed or left-handed) of the player Pis preset in the ball launch analysis device 1, the placement determination control part 103 determines whether or not the ball B was placed in the trigger zone of the capturing zone by using a camera corresponding to the dominant hand of the player P. When the dominant hand of the player P is right-handed, the player P launches the ball B from right to left with respect to the ball launch analysis device 1, so that the placement determination control part 103 determines whether or not the ball B was placed in the trigger zone Tb of the right capturing zone Z11*b* by using the right camera 11*b*. On the other hand, when the dominant hand of the player P is left-handed, the player P launches the ball B from left to right with respect to the ball launch analysis device 1, so that the placement determination control part 103 determines whether or not the ball B was placed in the trigger zone Ta of the left capturing zone Z11*a* by using the left camera 11*a*. In this way, it possible to reduce the amount of processing and to accurately determine whether the ball B was placed.

Also, when the placement determination control part 103 determines that the ball B was placed in either the left trigger zone Ta of the left capturing zone Z11*a* or the right trigger zone Tb of the right capturing zone Z11*b*, the placement determination control part 103 may calculate center coordinates of the world coordinate system (real coordinate system) of the ball B by using center coordinates of the camera coordinate system of the ball image 600 used for the determination, a radius of the ball image 600, the camera calibration information, and the law of cosines. As shown in FIG. 7A, the camera coordinate system has a center CI of the captured image P corresponding to a focal length f of the camera (for example, the left camera 11*a*) as the origin, the left-right direction xi of the captured image P as the x-axis direction, and the up-down direction yi of the captured image as the y-axis direction. Also, the world coordinate system has the center CR of the camera (the left camera 11*a*) as the origin, the left-right direction xr of the camera as the x-axis direction, the up-down direction yr of the camera as the y-axis direction, and the front-rear direction zr (depth direction) of the camera as the z-axis direction. The camera calibration information is information that associates an arbitrary point in the camera coordinate system with a corresponding point of the arbitrary point in the world coordinate system, and examples of such information include a K matrix and a P matrix. The captured image P is positioned perpendicular to the z axis at a position away from the center CR of the camera (right camera 11*a*) by the focal length f in the z axis direction toward the captured image P. The camera calibration information also converts the x-axis coordinate and y-axis coordinate of the camera coordinate system to the x-axis coordinate and y-axis coordinate of the world coordinate system. The z-axis coordinate of the camera coordinate system is also converted to the z-axis coordinate of the world coordinate system by using the radius b0*i* of the ball image and the law of cosines. The center coordinates b0*c* (b0*xr*, b0*yr*, b0*zr*) of the world coordinate system of ball B is calculated by using the center coordinates b0*c* (b0*xi*, b0*yi*) of the camera coordinate system of the ball image 600, the radius b0*i* of the ball image 600, camera calibration information of the camera (right camera 11*a*), and the law of cosines by using an angle θ between both ends of the ball image 600 and the center CR of the camera (right camera 11*a*). In this way, it is possible to calculate flight parameters of the ball B with high accuracy by combining the center coordinates of the world coordinate system of the ball B immediately after launch.

When the placement determination control part 103 determines that the ball B was placed in either the left trigger zone Ta of the left capturing zone Z10*a* or the right trigger zone Tb of the right capturing zone Z10*b*, the placement determination control part 103 may set a ball launch prediction zone PR including a ball image 600 and aligned with the launch direction of the ball B in the captured image used for the determination. As shown in FIG. 7A, when the captured image used for the determination is the right captured image 611*b* (one-directional captured image), the placement determination control part 103 may set a ball launch prediction zone PR of a predetermined shape (for example, a rectangular shape), the ball launch prediction zone PR including a ball image 600 and aligned with the right direction (one direction) (left direction in the world coordinate system) of the ball image 601, the right direction corresponds to the launch direction of the ball B. Also, the shape of the ball launch prediction zone PR is appropriately designed. In this way, it is possible to easily specify the ball image and to reduce the amount of processing when capturing the ball B immediately after launch.

When the determination of the placement determination control part 103 is completed (FIG. 4: S105 YES), the ball launch analysis device 1 enters to an infrared detection state, and an appearance determination control part 104 of the ball launch analysis device 1 activates the infrared sensor (here, right infrared sensor 10*b*) corresponding to the camera (here, right camera 11*b*) of the placement trigger zone (here, right trigger zone Tb) where the ball B was placed (FIG. 4: S106). Specifically, as shown in FIG. 7B, the appearance determination control part 104 enables the right infrared sensor 10*b* to detect the right detecting zone Z10*b*.

Figure 7B:
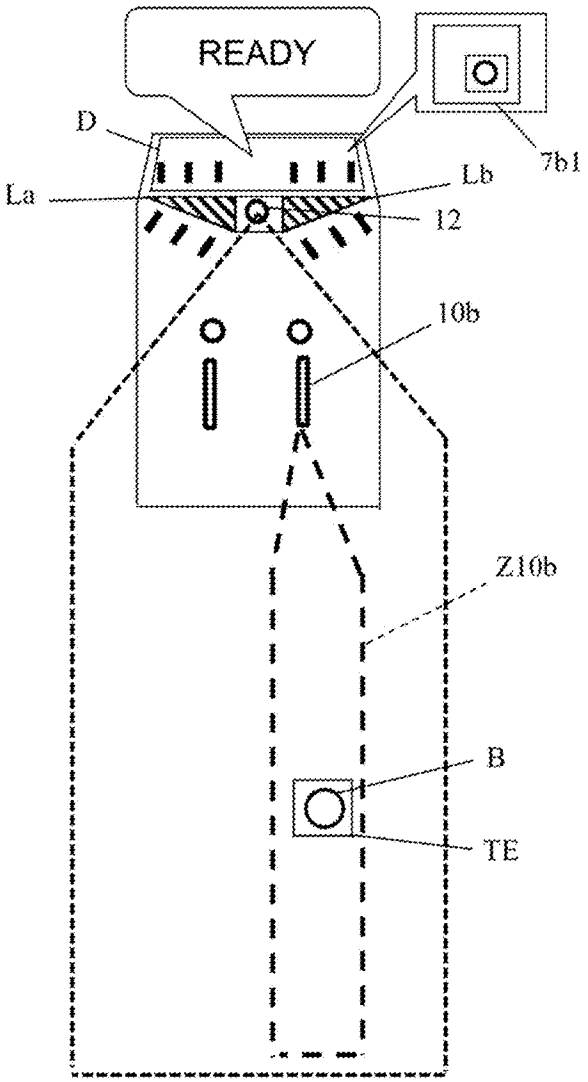
FIG. 7B is a schematic view indicating an example when the ball launch analysis device according to the present invention proceeds in an infrared detection state.
Figure 7A:
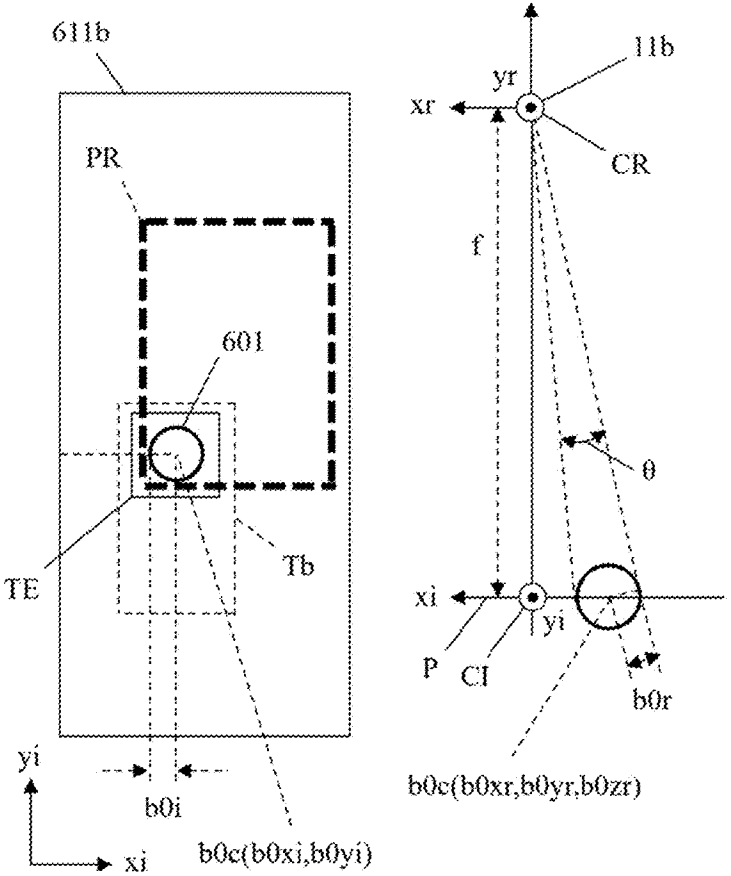
FIG. 7A is a diagram indicating an example of a captured image with a ball launch prediction zone set, and a relationship between a camera coordinate system and a world coordinate system.

As shown in FIG. 7B, the display control part 101 displays a message indicating a preparation state (for example, "READY") on the monitor D. In this way, it is possible to inform the player P of the preparation state.

The display control part 101 displays the captured image where the ball B was placed on the monitor D by using the camera that captures the captured image where it is determined that the ball B was placed. As shown in FIG. 7B, since it is determined that the ball B was placed in the right capturing zone Z11*b* of the right camera 11*b*, the display control part 101 displays the captured image 71*b* in the right capturing zone Z11*b* of the right camera 11*b* on the monitor D. In this way, it is possible for the player P to confirm the captured image 71*b* where the ball B was placed on the monitor D.

The display control part 101 activates the swing camera 12 (FIG. 4: S107) and captures the swing of the player P. In this way it is possible to capture a swing video from before the player P swings to after the player P swings. In addition, when the swing camera 12 is not installed, the display control part 101 may omit the activation of S107.

As shown in FIG. 7B, the lighting control part 102 changes the color of the left and right lights La, Lb to other color (e.g., green) that indicates a preparation state (FIG. 4: S108). In this way, it is possible to inform the player P of the preparation state for a swing. In addition, when the left and right lights La, Lb are not installed, the lighting control part 102 may omit the change of S108.

Next, the appearance determination control part 104 determines whether or not an object appeared in a placement detecting zone (right detecting zone Z10*b*) that includes a placement trigger zone (right trigger zone Tb) where the ball B was placed by using the infrared sensor (right infrared sensor 10*b*) corresponding to the camera (right camera 11*b*) of the placement trigger zone where the ball B was placed (FIG. 4: S109).

The determination method of the appearance determination control part 104 is not particularly limited. For example, as shown in FIG. 8A, the appearance determination control part 104 regularly acquires intensity of reflected light in the right detecting zone Z10*b* of the right infrared sensor 10*b*. The appearance determination control part 104 determines whether or not a change of the intensity of the reflected light in the right detecting zone Z10*b* exceeded a first appearance threshold. For example, the change means a subtraction value acquired by subtracting the intensity acquired immediately before from the most recently acquired intensity, or a subtraction value acquired by subtracting the intensity acquired initially from the most recently acquired intensity. The change has the same meaning below. The first appearance threshold is set appropriately based on the intensity of the reflected light from the club C.

When the change of the intensity of the reflected light in the right detecting zone Z10*b* exceeded the first appearance threshold, the appearance determination control part 104 determines that an object appeared in the right detecting zone Z10*b*. On the other hand, when the change of the intensity of the reflected light in the right detecting zone Z10*b* is within the first appearance threshold, the appearance determination control part 104 determines that an object did not appear in the right detecting zone Z10*b*. In this case, the appearance determination control part 104 continues to acquire the intensity of the reflected light in the right detecting zone Z10*b* and repeats the above-mentioned determination.

For example, when the player P leaves the tee ground S to take a practice swing, the intensity of the reflected light in the right detecting zone Z10*b* does not change, so the appearance determination control part 104 determines that an object did not appear in the placement detecting zone (FIG. 4: S109 NO). In this case, the appearance determination control part 104 returns to S109 and repeats the determination of the appearance of an object.

Figure 8B:
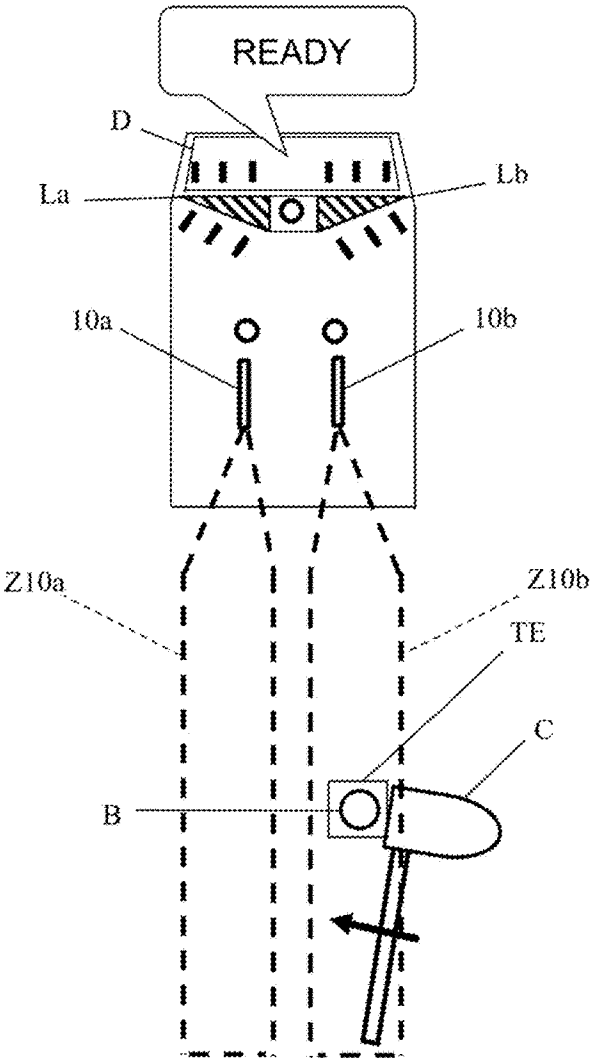
FIG. 8B is a drawing indicating an example when the club appeared in the right detecting zone in the ball launch analysis device according to the present invention.
Figure 8A:
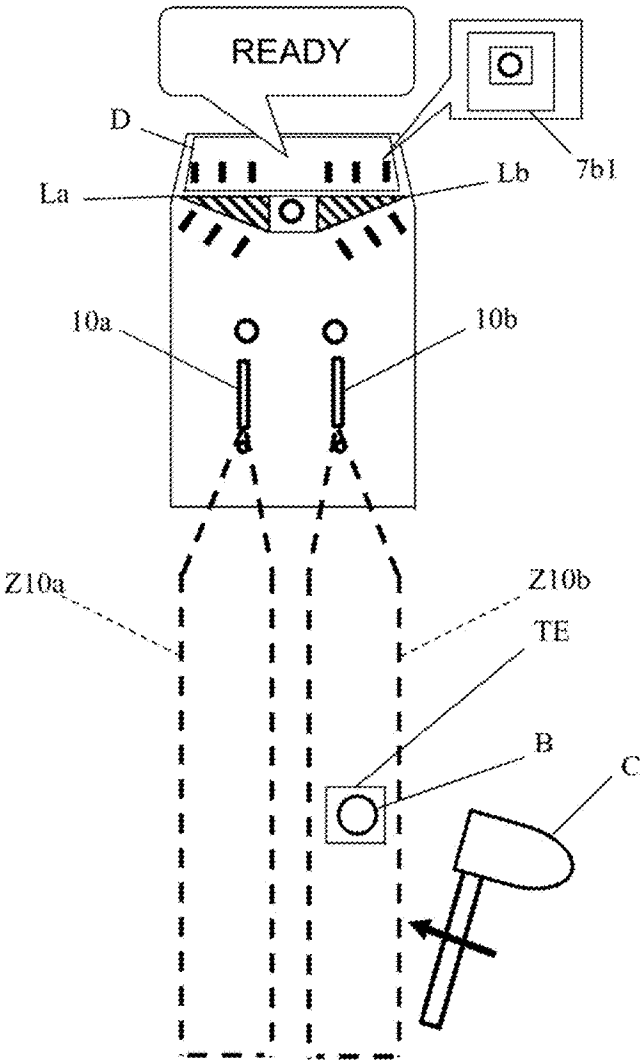
FIG. 8A is a drawing indicating an example before a club appears in the right detecting zone in the ball launch analysis device according to the present invention.

On the other hand, as shown in FIG. 8B, when the player P tries to launch the ball B with the club C, the club C appeared in the right detecting zone Z10*b*, the appearance determination control part 104 determines that the change of the intensity of the reflected light in the right detecting zone Z10*b* exceeded the first appearance threshold. And, the appearance determination control part 104 determines that the object (e.g., the club C) appeared in the placement detecting zone (FIG. 4: S109 YES). In this way, it is possible to detect with high accuracy that the player P tries to launch the ball B with the club C, without detecting that the player P takes a practice swing in other places.

When the determination of the appearance determination control part 104 is completed (FIG. 4: S109 YES), a disappearance determination control part 105 of the ball launch analysis device 1 determine whether or not the ball B disappeared from the placement detecting zone (right detecting zone Z10*b*) where the object appeared by using the infrared sensor (right infrared sensor 10*b*) corresponding to the placement detecting zone (FIG. 4: S110).

The determination method of the disappearance determination control part 105 is not particularly limited. For example, the disappearance determination control part 105 regularly acquires intensity of reflected light in the right detecting zone Z10*b* of the right infrared sensor 10*b*. Then, the disappearance determination control part 105 determines whether or not a change of the intensity of the reflected light in the right detecting zone Z10*b* exceeded a predetermined disappearance threshold. The disappearance threshold is appropriately set based on the intensity of the reflected light from the ball B.

When the change of the intensity of the reflected light in the right detecting zone Z10*b* exceeded the disappearance threshold, the disappearance determination control part 105 determines that the ball B disappeared from the right detecting zone Z10*b*. On the other hand, when the change of the intensity of the reflected light in the right detecting zone Z10*b* is within the disappearance threshold, the disappearance determination control part 105 determines that the ball B did not disappear from the right detecting zone Z10*b*. In this case, the disappearance determination control part 105 continues to acquire the intensity of the reflected light in the right detecting zone Z10*b* and repeats the above-mentioned determination.

Figure 9B:
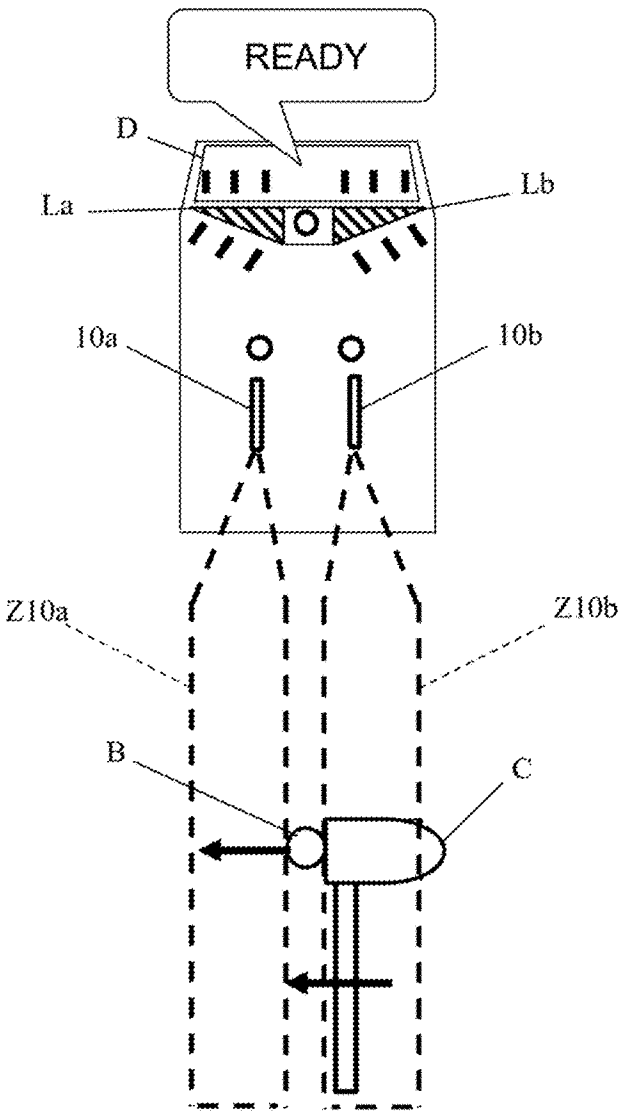
FIG. 9B is a drawing indicating an example when the ball disappeared from the right detecting zone in the ball launch analysis device according to the present invention.
Figure 9A:
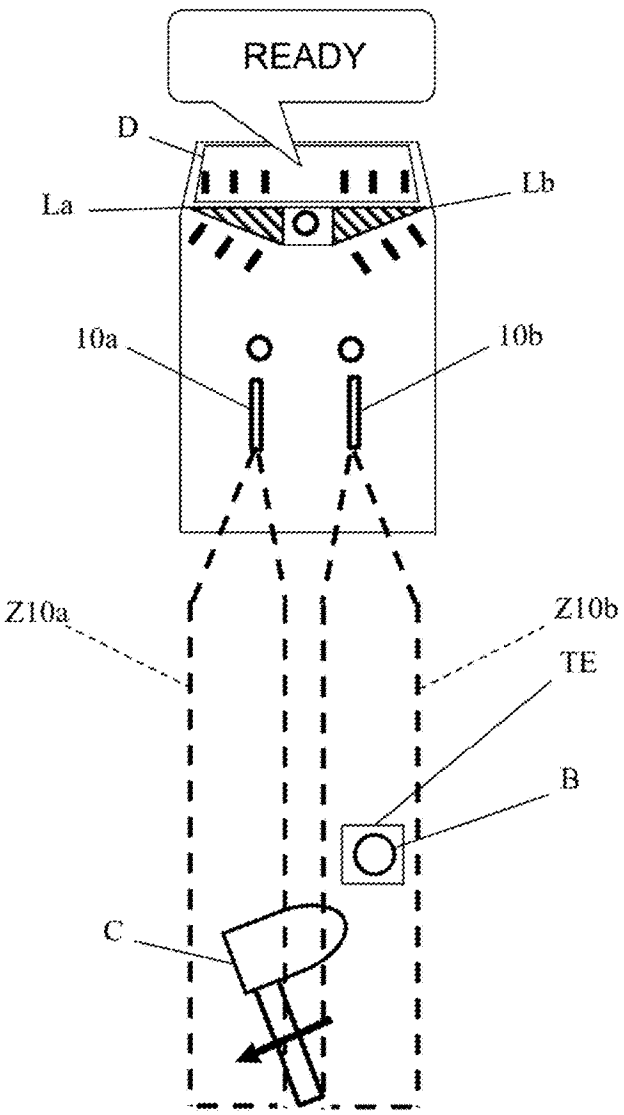
FIG. 9A is a drawing indicating an example when the player practiced swinging the club in the ball launch analysis device according to the present invention.

As shown in FIG. 9A, when the player P does not launch the ball B with the club C but simply takes a practice swing, the club C passes through the placement detecting zone Z10*b* and appeared in the adjacent detecting zone Z10*a*, but the ball B remains in the placement detecting zone Z10*b*. Then, although the intensity of the reflected light in the right detecting zone Z10*b* changes temporarily, the change of the intensity of the reflected light in the right detecting zone Z10*b* eventually falls within the disappearance threshold by the presence of the ball B. Therefore, the disappearance determination control part 105 determines that the ball B did not disappear from the placement detecting zone Z10*b* (FIG. 4: S110 NO). In this case, the disappearance determination control part 105 returns to S110 and repeats the determination of the disappearance of the ball B.

On the other hand, as shown in FIG. 9B, when the player P launches the ball B by using the club C, the ball B passes through the placement detecting zone Z10*b* together with the club C, and the ball B moves forward. Then, the intensity of the reflected light in the right detecting zone Z10*b* changes, and the change of the intensity of the reflected light in the right detecting zone Z10*b* exceeded the disappearance threshold. Therefore, the disappearance determination control part 105 determines that the ball B disappeared from the placement detecting zone Z10*b* (FIG. 4: S110 YES). In this way, it is possible to accurately detect when the ball B is reliably launched, without detecting a mere practice swing by the player P.

When the determination of the disappearance determination control part 105 is completed (FIG. 4: S110 YES), a next appearance determination control part 106 of the ball launch analysis device 1 determines whether or not the ball B appeared in a launch detecting zone (here, the left detecting zone Z10*a*) by using the infrared sensor (here, the left infrared sensor 10*a*) corresponding to the launch detecting zone adjacent to the placement detecting zone Z10*b* (FIG. 4: S111).

The determination method of the next appearance determination control part 106 is not particularly limited. For example, the next appearance determination control part 106 regularly acquires intensity of the reflected light in the left detecting zone Z10*a* of the left infrared sensor 10*a*. Then, the next appearance determination control part 106 determines whether or not a change of the intensity of the reflected light in the left detecting zone Z10*a* exceeded a second appearance threshold. The second appearance threshold is set appropriately based on the intensity of the reflected light from the ball B.

When the change of the intensity of the reflected light in the left detecting zone Z10*a* exceeded the second appearance threshold, the next appearance determination control part 106 determines that the ball B appeared in the left detecting zone Z10*a*. On the other hand, when the change of the intensity of the reflected light in the left detecting zone Z10*a* is within the second appearance threshold, the appearance determination control part 104 determines that the ball B did not appeared in the left detecting zone Z10*a*. In this case, the next appearance determination control part 106 continues to acquire the intensity of the reflected light in the left detecting zone Z10*a* and repeats the above-mentioned determination.

Figure 10B:
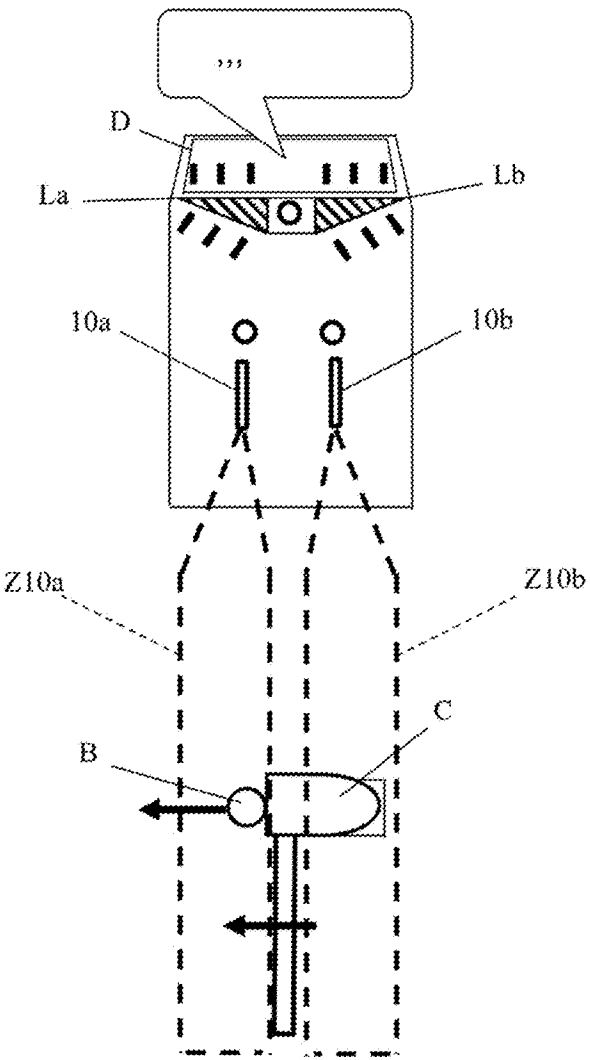
FIG. 10B is a drawing indicating an example when the ball flied forward in the launch direction in the ball launch analysis device according to the present invention.
Figure 10A:
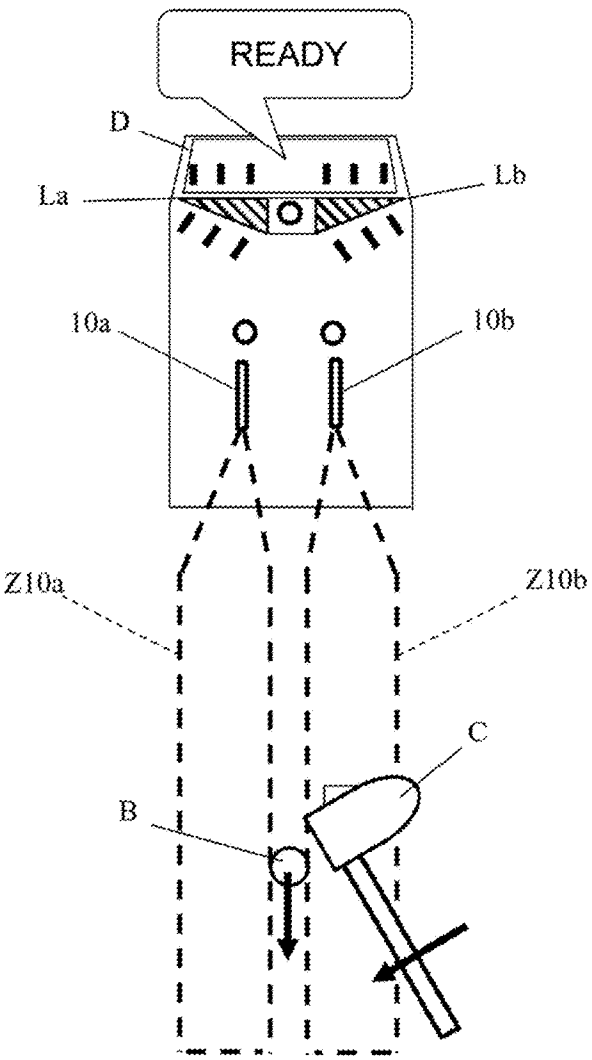
FIG. 10A is a drawing indicating an example when the ball did not fly in a launch direction in the ball launch analysis device according to the present invention.

As shown in FIG. 10A, when the player P launches the ball B with the club C, for some reason, the ball B does not fly forward in the launch direction, but flies to the left or right of the launch direction, or goes backwards, and does not fly in the launch direction, the ball B did not appear in the left detecting zone Z10*a*. Then, the next appearance determination control part 106 determines that the change of the intensity of the reflected light in the left detecting zone Z10*a* is within the second appearance threshold (FIG. 4: S111 NO). In this case, since the ball B disappeared once, the next appearance determination control part 106 returns to S105, and the placement determination control part 103 again determines that the ball B was placed.

On the other hand, as shown in FIG. 10B, when the player P launches the ball B forward with the club C, the ball B appears in the left detecting zone Z10*a*. Then, the next appearance determination control part 106 determines that the change of the intensity of the reflected light in the left detecting zone Z10*a* exceeded the second appearance threshold, and determines that the ball B appeared in the left detecting zone Z10*a* (FIG. 4: S111 YES). In this way, it is possible to detect that the ball B is reliably launched in the launch direction without detecting any unusual launch of the ball B.

When the determination of the next appearance determination control part 106 is completed (FIG. 4: S111 YES), a signal transmission control part 107 of the ball launch analysis device 1 transmits a trigger signal (FIG. 4: S112). By the transmission time of this trigger signal, it is possible to estimate the launch time of ball B.

When the transmission of the signal transmission control part 107 is completed (FIG. 4: S112), a capture control part 108 of the ball launch analysis device 1 captures the ball B continuously in the left capturing zone Z11*a* and the right capturing zone Z11*b* by using the left and right cameras 11*a*, 11*b* (FIG. 4: S113).

The continuous capturing method of the capture control part 108 is not particularly limited. For example, as shown in FIG. 11A, when the capture control part 108 receives the trigger signal, the capture control part 108 performs capturing continuously at a predetermined capturing speed (for example, 1000 fps) by using the left and right cameras 11*a*, 11*b*. The continuous capturing method is not particularly limited. For example, when the left and right cameras 11*a*, 11*b* are slow capturing cameras, the capture control part 108 applies high-speed capturing software to the left and right cameras 11*a*, 11*b*, it is possible to high-speed capture even with the slow capturing cameras. When the left and right cameras 11*a*, 11*b* are high-speed capturing cameras, the capture control part 108 may perform high-speed capturing with the left and right cameras 11*a*, 11*b*.

Figure 11B:
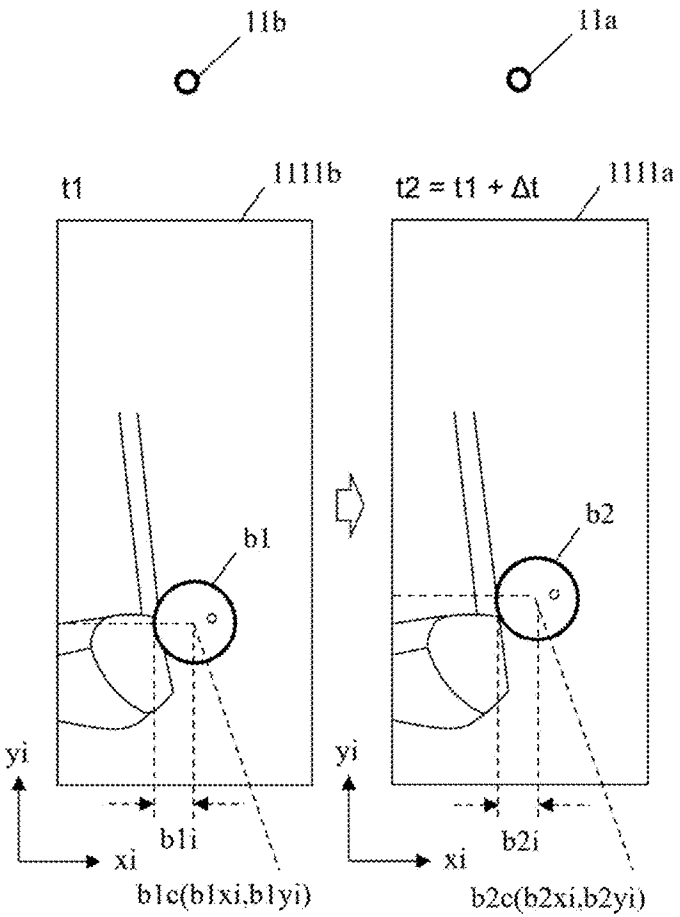
FIG. 11B is a drawing indicating an example when the ball was captured with the right camera at a first time and the ball was captured with the left camera at the second time.
Figure 11A:
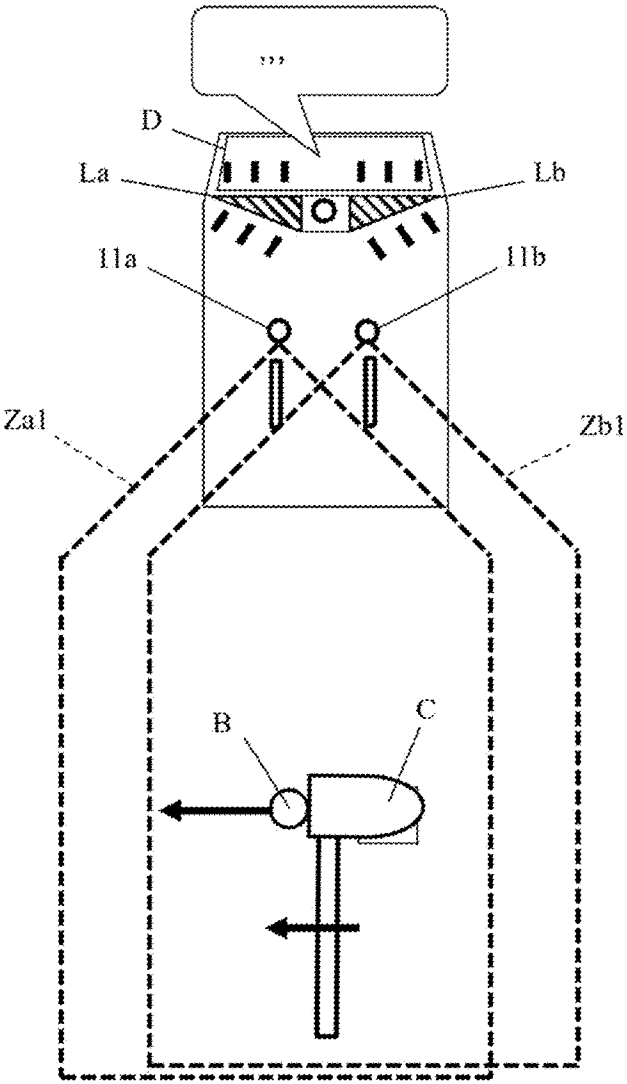
FIG. 11A is a drawing indicating an example when a continuous capturing is performed by transmitting a trigger signal in the ball launch analysis device according to the present invention.

As shown in FIG. 11B, the capture control part 108 captures the ball B in the right capturing zone Z11*b* by using the right camera 11*b* corresponding to the infrared sensor (right infrared sensor 10*b*) of the placement detecting zone Z10*b* at the first time t1 immediately after the transmission time t0 of the trigger signal, and obtains a right captured image 1111*b*. And the capture control part 108 captures the ball B in the left capturing zone Z11*a* by using the left camera 11*a* corresponding to the infrared sensor 10*a* of the launch detecting zone Z10*a* at the second time t2 obtained by adding a predetermined time (Δt) to the first time t1, and obtains a left captured image 1111*a*. The predetermined time (Δt) is appropriately set according to the performance of the camera. In this way, it is possible to capture continuous images of the ball B, even the ball B is at high speed, by using the right camera 11*b* and the left camera 11*a*, in the order along the launch direction of the ball B.

When the continuous capturing of the capture control part 108 is completed (FIG. 4: S113), a calculation control part 109 of the ball launch analysis device 1 calculates flight parameters of the ball B based on ball images of the ball B continuously captured by the left and right cameras 11*a*, 11*b* (FIG. 4: S114).

The calculation method of the calculation control part 109 is not particularly limited. For example, the calculation control part 109 specifies a ball image from each of the images captured at two different times by performing the image processing of S105 described above on two consecutively captured images. As shown in FIG. 11B, the calculation control part 109 performs the image processing on each of the first captured image (here, right captured image 1111*b*) at the first time t1 and the second captured image (here, left captured image 1111*a*) at the second time t2. Then, the calculation control part 109 specifies the first ball image b1 from the first captured image 1111*b* at the first time t1, and specifies the second ball image b2 from the second captured image 1111*a* at the second time t2.

Figures 12A, 12B:
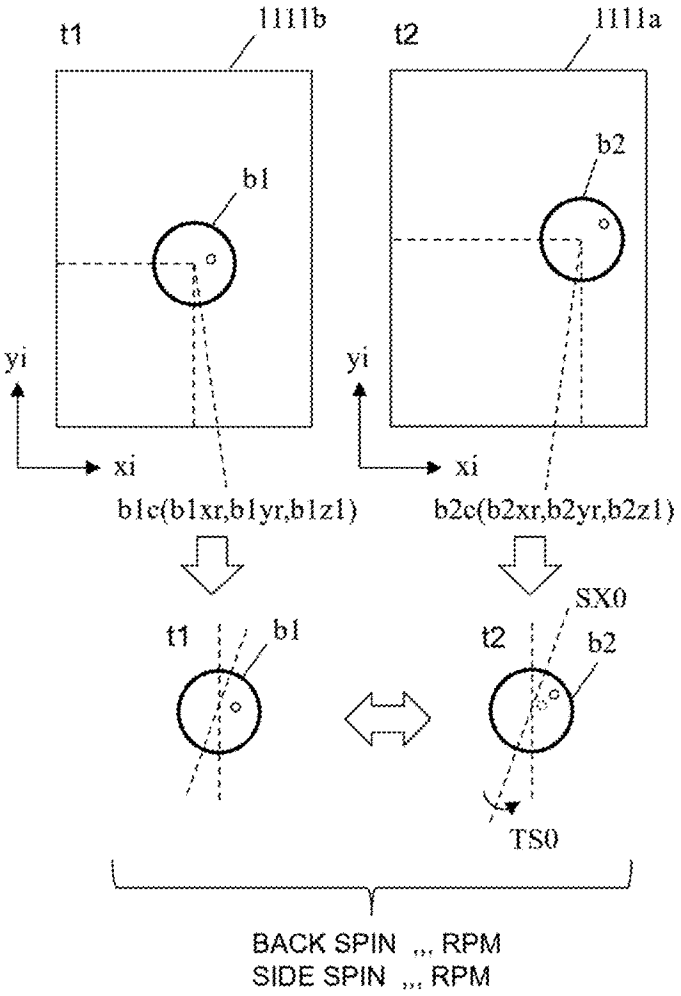
FIG. 12A is a drawing indicating an example when flight parameters from ball speed to side angle are calculated based on ball images captured at two different times.
FIG. 12B is a drawing indicating an example when flight parameters from backspin to sidespin are calculated based on ball images captured at two different times.

Next, the calculation control part 109 calculates center coordinates of the world coordinate system of the ball image by using center coordinates of the camera coordinate system of the specified ball image, a radius of the ball image, the camera calibration information, and the law of cosines by performing the image processing of S105 YES described above. As shown in FIG. 12A, the calculation control part 109 calculates center coordinates b1*c* (b1*xr*, b1*yr*, b1*zr*) of the world coordinate system of the first ball B (ball B at the first time t1) corresponding to the first ball image b1 by using center coordinates b1*c* (b1*xi*, b1*yi*) of the camera coordinate system of the first ball image b1, the radius b1*i* of the first ball image b1, the camera calibration information of the right camera 10*b*, and the law of cosines. Next, the calculation control part 109 calculates the center coordinates b2*c* (b2*xr*, b2*yr*, b2*zr*) of the world coordinate system of the second ball B (ball B at the second time t2) corresponding to the second ball image b2 by using the center coordinates b2*c* (b2*xi*, b2*yi*) of the camera coordinate system of the second ball image b2, the radius b2*i* of the second ball image b2, the camera calibration information of the left camera 10*a*, and the law of cosines.

Then, the calculation control part 109 calculates a ball speed BS (m/s), a launch angle LA (degrees), and a side angle SA (degrees) among the flight parameters by using each of the center coordinates of the world coordinate system of the ball B at two different times. Here, the ball speed BS is a division value obtained by dividing a ball distance between the center coordinates b2*c* (b2*xr*, b2*yr*, b2*zr*) of the world coordinate system of the second ball B and the center coordinates b1*c* (b1*xr*, b1*yr*, b1*zr*) of the world coordinate system of the first ball B by a subtraction time obtained by subtracting the first time t1 from the second time t2. The launch angle LA is an angle formed by the ball distance and the horizontal plane. The side angle SA is an angle of left and right curve direction with respect to the launch direction of the ball B, and for example, the side angle SA is the angle of the left and right curve direction in the z-axis direction with respect to the x-axis direction of the launch direction. The calculation control part 109 also calculates a carry CA (m) by using the ball speed BS and a parabola formula of the ball B. The carry CA is a distance from where the ball B is launched to where the ball B lands, and it is possible to substitute the ball speed BS as the initial velocity into the parabola formula of the ball B. The carry CA can also be converted from m to yards (YDS), 1 yard is 0.9144 m. In this way, it is possible to calculate the ball speed BS, the launch angle LA, the side angle SA, and the carry CA from the center coordinates in the world coordinate system of the ball images at two different times.

The calculation control part 109 also calculates a rotation axis SX0 and a spin rate TSO of the ball B by using the ball images b1 and b2 at two different times. For example, as shown in FIG. 12B, the calculation control part 109 matches a size of the first ball image b1 at the first time t1 to a size of the second ball image b2 at the second time t2, virtually rotates the first ball image b1 with the matched size, and matches a surface image of the virtually rotated first ball image b1 to a surface image of the second ball image b2. The calculation control part 109 calculates the rotation axis SX0 and the spin rate TSO when the first ball image b1 with the matched surface image is virtually rotated. Then, the calculation control part 109 calculates a backspin BS (rpm) and a side spin SS (rpm) by using the calculated rotation axis SX0 and spin rate TSO. The backspin BS is a rotation speed in the direction opposite to the launch direction of the ball B, and the side spin SS is a rotation speed in the left or right curve direction with respect to the launch direction of the ball B, for example, the side spin SS is a rotation speed in the z-axis direction in the left or right curve direction with respect to the x-axis direction of the launch direction. In this way, it is possible to calculate the backspin BS and the side spin SS from the ball images captured at two different times. In addition, the calculation method of the calculation control part 109 is not limited.

As described above, the flight parameters may include, for example, the ball speed BS, the launch angle LA, the side angle SA, the carry CA, the backspin BS, and the side spin SS, and other flight parameters may also be added.

Figure 13B:
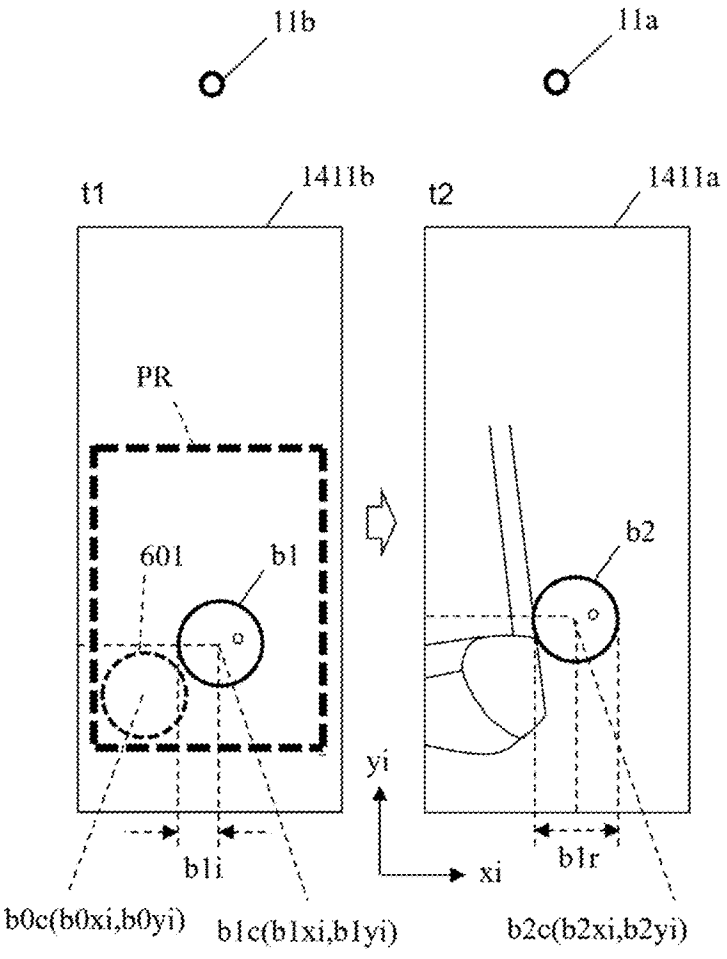
FIG. 13B is a drawing indicating an example when a first ball image at a first time is specified by using a ball launch prediction zone, and flight parameters are calculated by using center coordinates of the ball in the world coordinate system at the time of placement.
Figure 13A:
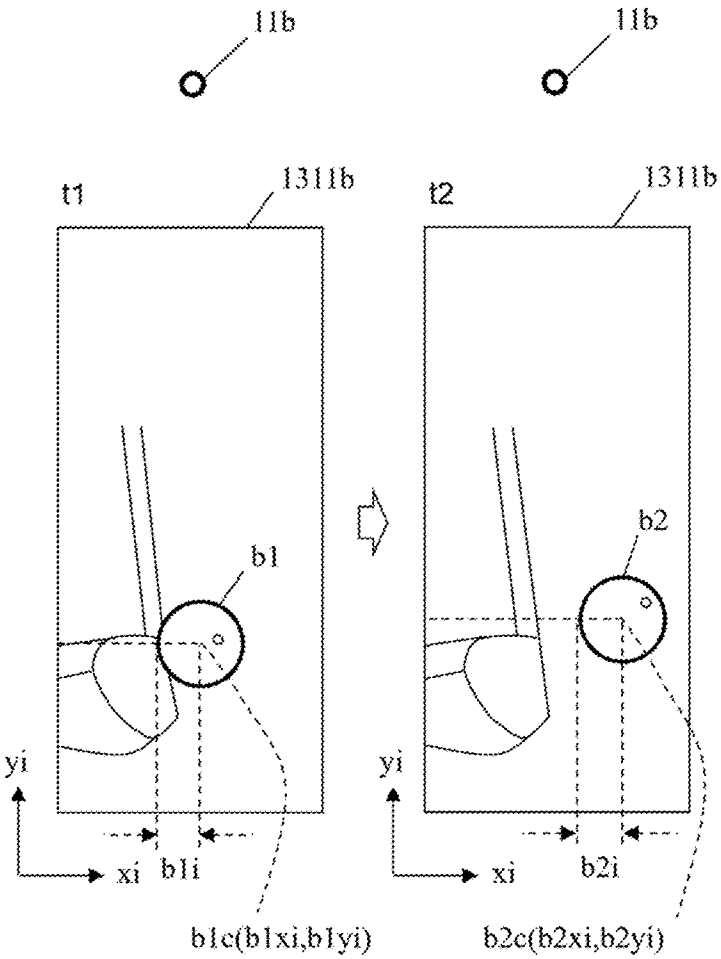
FIG. 13A is a drawing indicating an example when two captured images are acquired at different times with the same camera.

In the above description, the capture control part 108 captures the ball B by using the right camera 11*b* at the first time t1, and captures the ball B by using the left camera 11*a* at the second time t2. However, this is not limited to the above. For example, in the case of a high-performance camera, as shown in FIG. 13A, the capture control part 108 may capture the ball B in the right capturing zone Z11*b* by using the right camera 11*b* at the first time t1 to obtain a right captured image 1311*b* at the first time t1, and may capture the ball B in the right capturing zone Z11*b* by using the same right camera 11*b* at the second time t2 to obtain a right captured image 1311*b* at the second time t2. In this case, the calculation control part 109 may calculate the flight parameters of the ball B by using the two right captured images 1311*b* at the first time t1 and the second time t2.

In the above description, the calculation control part 109 specifies the ball image by performing the image processing of S105 described above on all of the captured images, but this is not limited. For example, when the placement determination control part 103 sets a ball launch prediction zone PR for the captured images, as shown in FIG. 13B, the calculation control part 109 may set the ball launch prediction zone PR in the captured image 1411*b* at the first time t1, perform the image processing on the ball launch prediction zone PR, specify a first ball image b1, and calculate flight parameters of the ball B. In this way, it is possible to easily specify the ball image and to reduce the amount of processing.

In the above description, as shown in FIG. 12, the calculation control part 109 calculates the flight parameters of the ball B by using the right captured image 1111*b* at the first time t1 and the right captured image 1111*a* at the second time t2, but this is not limited. For example, the placement determination control part 103 may add center coordinates b0*c* (b0*xr*, b0*yr*, b0*zr*) of the world coordinate system of the ball B at the placement time (in other words, the transmission time to of the trigger signal) to the center coordinates b1*c* (b1*xr*, b1*yr*, b1*zr*) of the world coordinate system of the first ball B at the first time t1 and the center coordinates b2*c* (b2*xr*, b2*yr*, b2*zr*) of the world coordinate system of the second ball B, and the calculation control part 109 calculates the flight parameters of the ball B by using the center coordinates b0*c* (b0*xr*, b0*yr*, b0*zr*) of the world coordinate system of the ball B at the placement time. In this way, it is possible to calculate the flight parameters of the ball B with high accuracy.

When the calculation of the flight parameters by the calculation control part 109 is completed (FIG. 4: S114), the calculation control part 109 determines whether or not the calculated flight parameters are normal (FIG. 4: S115).

The determination method of the calculation control part 109 is not particularly limited. For example, the calculation control part 109 refers to a flight parameter normal range preset in a predetermined memory for each of the flight parameters, and determines whether or not the calculated flight parameter is within the flight parameter normal range for each of the flight parameters. Specifically, for example, when the flight parameter is ball speed BS, the flight parameter normal range is set to 1 m/s or more, and the calculation control part 109 determines whether the calculated ball speed BS of the flight parameter is 1 m/s or more of the flight parameter normal range. When the ball speed BS is 1 m/s or more of the flight parameter normal range, the calculation control part 109 can determine that the ball B fried normally. Also, for example, when the flight parameter is launch angle LA, the flight parameter normal range is set to 70 degrees or less, the calculation control part 109 determines whether the calculated launch angle LA of the flight parameter is 70 degrees or less of the flight parameter normal range. When the launch angle LA is 70 degrees or less of the flight parameter normal range, the calculation control part 109 can determine that the ball B fried normally. Such processing is designed appropriately according to the type of flight parameters, and it is possible to perform for all flight parameters or only for specific flight parameters. In this way, by determining whether the flight parameters are normal or not, it is possible to determine when a calculation error occurred for some reason.

As a result of the determination, when the calculated flight parameters are not normal, the calculation control part 109 determines that the launch of the player P was unsuccessful (FIG. 4: S115 NO). In this case, the calculated flight parameters are not displayed, the calculation control part 109 displays a redo, proceeds the process to S105, and prompts the player P to place the ball B again.

On the other hand, as a result of the determination, when the calculated flight parameters are normal, the calculation control part 109 determines that the launch of the player P was successful, and displays the calculated flight parameters (FIG. 4: S115 YES). In this way, it is possible to display only the appropriate flight parameters. In addition, the determination process of S115 may be omitted.

When the calculation of the calculation control part 109 is completed, the display control part 101 displays the calculated flight parameters on the monitor D (FIG. 4: S116).

Figure 14:
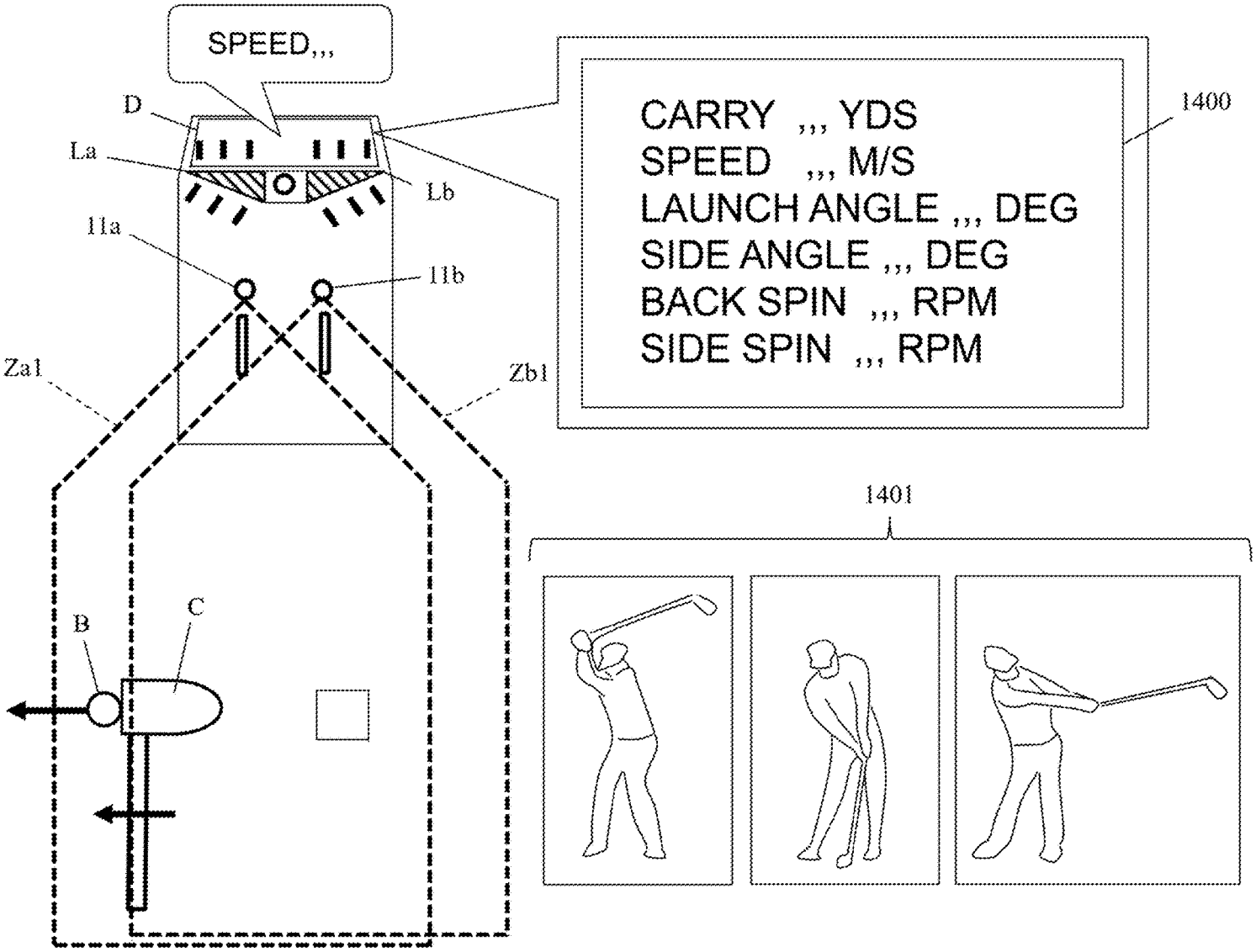
FIG. 14 is a drawing indicating an example when the flight parameters and a swing video are displayed in the ball launch analysis device according to the present invention.

The display method of the display control part 101 is not particularly limited. For example, as shown in FIG. 14, the display control part 101 displays the carry CA (YDS), the ball speed BS (m/s), the launch angle LA (DEG), the side angle SA (DEG), the backspin BS (RPM), and the side spin SS (RPM) that are calculated on a screen 1400 of the monitor D. In this way, it is possible that the player P knows the flight parameters of the ball B for his own swing.

When the swing camera 12 is activated (FIG. 4: S107), the display control part 101 displays the flight parameters (FIG. 4: S116), and displays video (or image) captured by the swing camera 12 (FIG. 4: S117). Here, as described above, the display control part 101 acquires video before and after the transmission time of the trigger signal as swing video by using the transmission time of the trigger signal indicating the launch of the ball B, and as shown in FIG. 14, the display control part 101 displays the swing video 1401 from before the player P swings to after the swing. In this way, it is possible that the player P checks his own swing on the video (or image). In addition, when the swing camera 12 is not installed, the display control part 101 may omit the activation of S117.

After the display control part 101 displays the flight parameters (FIG. 4: S116) or displays the video captured by the swing camera 12 (FIG. 4: S117), the ball launch analysis device 1 ends the processes. When the player P wants to swing again, he operates the ball launch analysis device 1 to return to S101 or S102 and repeat the above-mentioned processes.

In this way, the present invention is capable of performing with high accuracy from the launch of the ball to an analysis of flight parameters of the ball by appropriately combining the infrared sensors and the cameras.

EXAMPLES

The present invention will be explained below according to Examples, etc., and does not limit by there.

Figure 15:
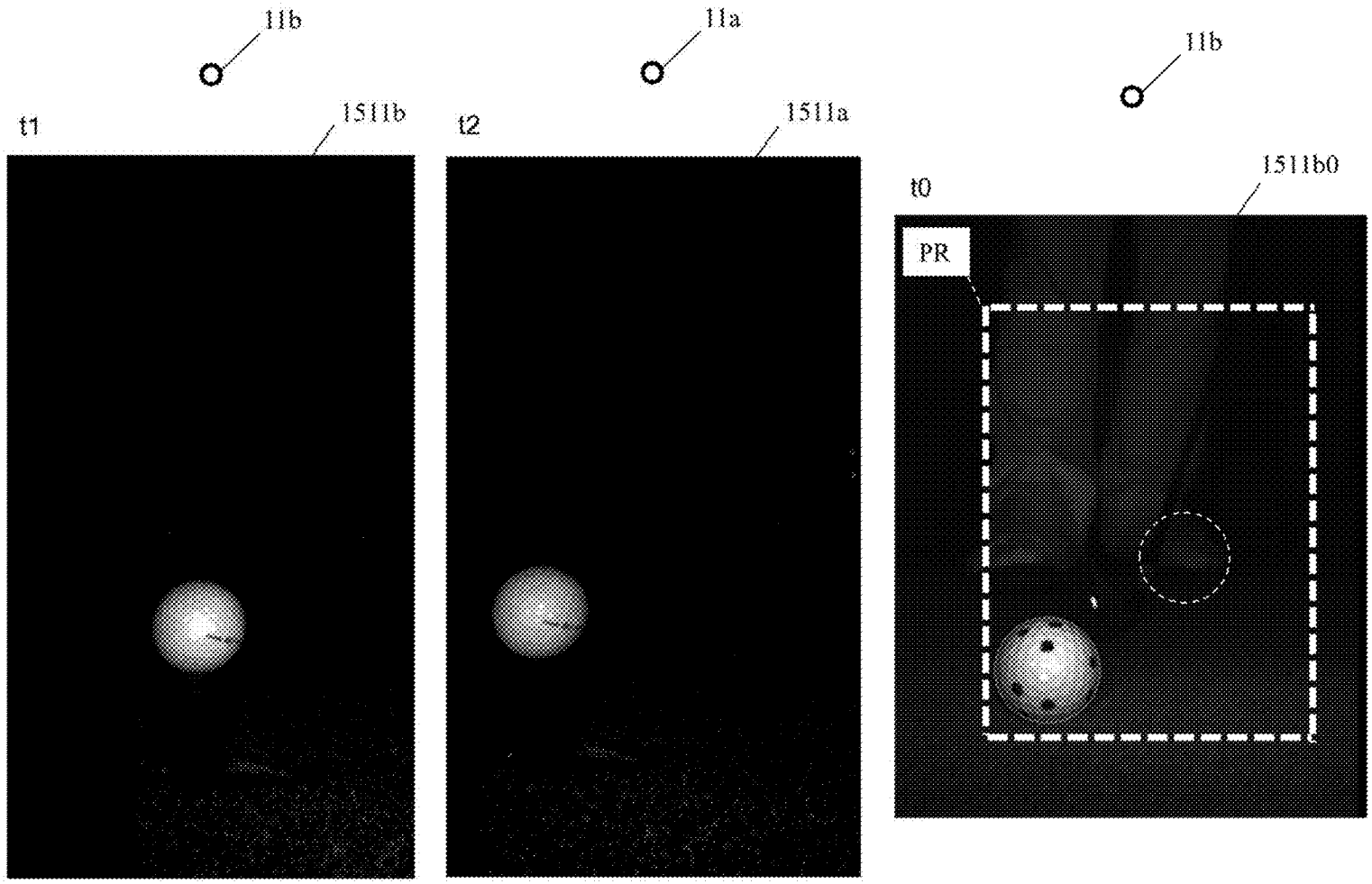
FIG. 15 is a drawing indicating an example when a captured image of the ball captured by the right camera at a first time, a captured image of the ball captured by the left camera at a second time, and a ball launch prediction zone is set at the time of placement in Example.

First, a prototype of the ball launch analysis device 1 was created based on FIGS. 1 to 14, and this ball launch analysis device 1 was used as Example. By using the ball launch analysis device 1 of Example, captured images were acquired when a player P launched a ball B, and as shown in FIG. 15, a captured image 1511*b* at a first time t1 and a captured image 1511*a* at a second time t2 could be acquired. By using these two captured images, normal flight parameters could be calculated.

As shown in FIG. 15, by setting a ball launch prediction zone PR in the captured image 1511*b*0 at the placement time to, the amount of processing required to specify the first ball image b1 in the captured image 1511*b* at the first time t1 is reduced, and it has become easier to specify the first ball image b1.

Figure 16:
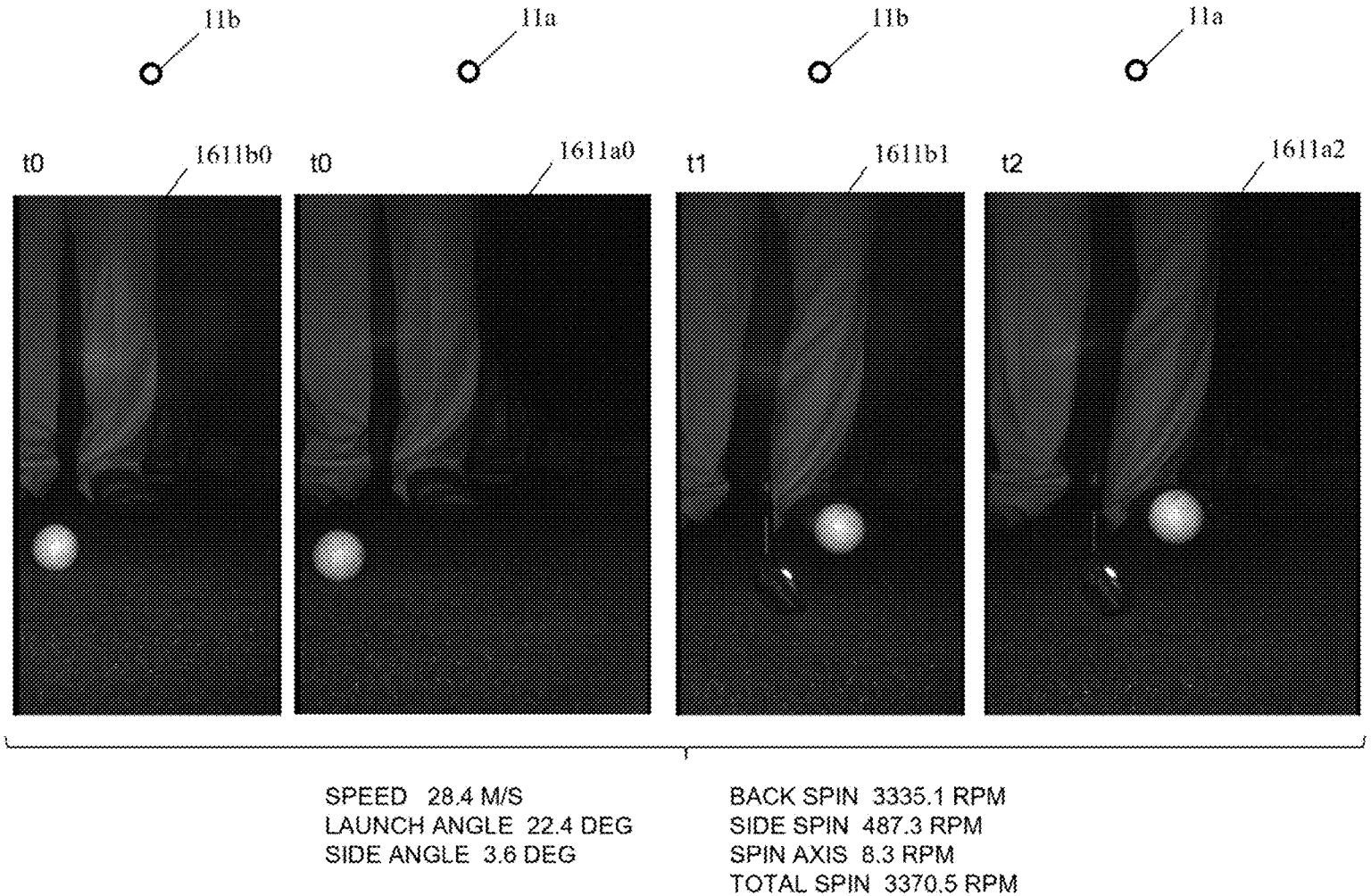
FIG. 16 is a drawing indicating an example when images of the ball captured by the left and right camera at the time of placement, a captured image of the ball captured by the right camera at the first time, and a captured image of the ball captured by the left camera at the second time in Example.

Next, the flight parameters were calculated by using the image captured at the placement time to, the image captured at the first time t1, and the image captured at the second time t2. When the ball launch analysis device 1 of Example determines that the ball B was placed in the trigger zone, as shown in FIG. 16, the ball launch analysis device 1 acquires a first image 1611*a*0 at the placement time to with the left camera 11*a*, acquires a second image 1611*b*0 at the placement time to with the right camera 11*b*, and calculates the center coordinates of the ball B in the world coordinate system. Next, when the ball B is launched by the player P, the ball launch analysis device 1 of Example detects the launch of the ball B by using the left and right infrared sensors 10*a*, 10*b*, acquires a third image 1611*b*1 at the first time t1 with the right camera 11*b*, and acquires a fourth image 1611*a*2 at the second time t2 with the left camera 11*a*. Then, when the ball launch analysis device 1 of Example calculates the flight parameters by using the first captured image 1611*a*0, the second captured image 1611*b*0, the third captured image 1611*b*1, and the fourth captured image 1611*a*2, the ball speed BS is 28.4 (m/s), the launch angle LA is 22.4 (degrees), the side angle SA is 3.6 (degrees), the backspin BS is 3335.1 (rpm), and the side spin SS is 487.3 (rpm). From the backspin BS and the side spin SS, the rotation axis SX0 (SPIN AXIS) is 8.3 (rpm), and the rotation rate TSO (TOTAL SPIN) is 3370.5 (rpm). These values are equivalent to the values of a commercially available flight parameter analysis device, and are normal flight parameters. The result for only the third image and the fourth image was the same.

In the embodiment of the present invention, the ball launch analysis device 1 applied to the golf ball has been described; however, the present invention is not limited to this and the present invention can be widely applied as a device for performing operations ranging from launching a ball to analyzing the flight parameters of a ball in ball games in which a stopped ball B is launched, such as baseball, tennis, soccer, rugby, ice hockey, and gateball.

In the embodiment of the present invention, the rectangular detecting zone is formed by using the slit in the infrared sensor, but the present invention is not limited to this, and detecting zones of various shapes may be formed. First, the present invention determines whether or not an object appeared in the placement detecting zone by using the infrared sensor corresponding to the camera in the placement trigger zone, and when the ball disappeared, the present invention determines whether or not the ball appeared by using the infrared sensor corresponding to the launch detecting zone adjacent to the placement detecting zone, but the present invention is not limited to this. For example, when the ball was placed in either the left trigger zone or the right trigger zone, the present invention determines whether or not an object appeared by using an infrared sensor corresponding to the camera in the placement trigger zone, an infrared sensor corresponding to the launch detecting zone adjacent to the placement detecting zone is also activated, and the present invention may determine whether or not the object appeared. In other words, in this case, the left and right infrared sensors 10*a*, 10*b* may be activated.

In the embodiment of the present invention, the ball launch analysis device 1 is configured to include each control part, but it may be configured to store a program that realizes each control part in a storage medium and provide the storage medium. In this configuration, the program is read out to the device, and the device realizes each control part. In that case, the program itself read out from the recording medium provides the effect of the present invention. Furthermore, it is also possible to provide it as a method of storing the steps executed by each control part in a hard disk.

INDUSTRIAL APPLICABILITY

As described above, the ball launch analysis device and ball launch analysis method according to the present invention are effective as devices and methods applicable to any ball game in which a stopped ball is launched, and they are effective as a ball launch analysis device and ball launch analysis method that can perform with high accuracy from a launch of a ball to an analysis of flight parameters of the ball by appropriately combining infrared sensors and cameras.

REFERENCE SIGNS LIST

1 BALL LAUNCH ANALYSIS DEVICE
101 DISPLAY CONTROL PART
102 LIGHTING CONTROL PART
103 PLACEMENT DETERMINATION CONTROL PART
104 APPEARANCE DETERMINATION CONTROL PART
105 DISAPPEARANCE DETERMINATION CONTROL PART
106 NEXT APPEARANCE DETERMINATION CONTROL PART
107 SIGNAL TRANSMISSION CONTROL PART
108 CAPTURE CONTROL PART
109 CALCULATION CONTROL PART

What is claimed is:

1. A ball launch analysis device comprising:

left and right infrared sensors being provided on left and right sides of the device respectively, and being capable of detecting a left detecting zone and a right detecting zone respectively, wherein the left detecting zone and the right detecting zone are adjacent to each other and do not overlap;

left and right cameras being provided on the left and right sides of the device respectively, and being capable of capturing a left capturing zone and a right capturing zone including the left detecting zone and the right detecting zone respectively, wherein the left capturing zone and the right capturing zone overlap each other;

a placement determination control part determining whether or not a ball was placed in either a left trigger zone that is preset within the left detecting zone in the left capturing zone or a right trigger zone that is preset within the right detecting zone in the right capturing zone by using the left and right cameras;

an appearance determination control part determining whether or not an object appeared in a placement detecting zone including a placement trigger zone by using the infrared sensor corresponding to the camera of the placement trigger zone where the ball was placed when it is determined that the ball was placed in either the left trigger zone or the right trigger zone by the placement determination control part;

a disappearance determination control part determining whether or not the ball disappeared from the placement detecting zone where the object appeared by using the infrared sensor corresponding to the placement detecting zone when it is determined that the object appeared in the placement detecting zone by the appearance determination control part;

a next appearance determination control part determining whether or not the ball appeared in a launch detecting zone by using the infrared sensor corresponding to the launch detecting zone adjacent to the placement detecting zone when it is determined that the ball disappeared from the placement detecting zone by the disappearance determination control part;

a signal transmission control part transmitting a trigger signal when it is determined that the ball appeared in the launch detecting zone by the next appearance determination control part;

a capture control part capturing the ball continuously in the left capturing zone and the right capturing zone by using the left and right cameras when the trigger signal is transmitted; and a calculation control part calculating flight parameters of the ball based on ball images of the ball continuously captured by the left and right cameras.

2. The ball launch analysis device according to claim 1, wherein:

the placement determination control part searches whether or not there is a ball image corresponding to the ball as a circular image in the captured image of the left capturing zone or the captured image of the right capturing zone, when the placement determination control part can not search the ball image as a circular image, the placement determination control part determines that the ball was not placed in either the left trigger zone of the left capturing zone or the left trigger zone of the right capturing zone, when the placement determination control part can search the ball image as a circular image, the placement determination control part acquires position information of the trigger zone of the capturing zone where the ball image of the circular image is searched, and determines whether or not the searched ball image is included inside the trigger zone, when the ball image is not included inside the trigger zone, the placement determination control part determines that the ball was not placed in either the left trigger zone of the left capturing zone or the left trigger zone of the right capturing zone, and when the ball image is included inside the trigger zone, the placement determination control part determines that the ball was placed in either the left trigger zone of the left capturing zone or the left trigger zone of the right capturing zone.

3. The ball launch analysis device according to claim 1, further comprising:

a display control part displaying captured image where the ball was placed on a monitor by using the camera that captures the captured image where it is determined that the ball was placed.

4. The ball launch analysis device according to claim 1, further comprising:

a swing camera capturing a swing zone that overlaps a left capturing zone of the left camera and a right capturing zone of the right camera, and a display control part activating the swing camera, capturing a swing of the player, and displaying video captured by the swing camera.

5. The ball launch analysis device according to claim 1, wherein:

the appearance determination control part regularly acquires intensity of reflected light in the placement detecting zone of the infrared sensor, and determines whether or not a change of the intensity of the reflected light in the placement detecting zone exceeded a first appearance threshold, when the change of the intensity of the reflected light in the placement detecting zone is within the first appearance threshold, the appearance determination control part determines that an object did not appear in the placement detecting zone, and when the change of the intensity of the reflected light in the placement detecting zone exceeded the first appearance threshold, the appearance determination control part determines that an object appeared in the placement detecting zone.

6. The ball launch analysis device according to claim 1, wherein:

the disappearance determination control part regularly acquires intensity of reflected light in the placement detecting zone of the infrared sensor, and determines whether or not a change of the intensity of the reflected light in the placement detecting zone exceeded a predetermined disappearance threshold, when the change of the intensity of the reflected light in the placement detecting zone is within the disappearance threshold, the disappearance determination control part determines that the ball did not disappear from the placement detecting zone, and when the change of the intensity of the reflected light in the placement detecting zone exceeded the disappearance threshold, the disappearance determination control part determines that the ball disappeared from the placement detecting zone.

7. The ball launch analysis device according to claim 1, wherein:

the next appearance determination control part regularly acquires intensity of reflected light in the launch detecting zone of the infrared sensor, and determines whether or not a change of the intensity of the reflected light in the launch detecting zone exceeded a second appearance threshold, when the change of the intensity of the reflected light in the launch detecting zone is within the second appearance threshold, the appearance determination control part determines that an object did not appeared in the launch detecting zone, and when the change of the intensity of the reflected light in the launch detecting zone exceeded the second appearance threshold, the next appearance determination control part determines that an object appeared in the launch detecting zone.

8. The ball launch analysis device according to claim 1, wherein:

the calculation control part determines whether or not the calculated flight parameters are normal, when the calculated flight parameters are not normal, the calculation control part determines that the launch of the player was unsuccessful, and displays a redo, and when the calculated flight parameters are normal, the calculation control part determines that the launch of the player was successful, and displays the calculated flight parameters.

9. The ball launch analysis device according to claim 1, wherein:

the capture control part captures the ball in the capturing zone by using the camera corresponding to the infrared sensor of the placement detecting zone at the first time immediately after the transmission time of the trigger signal, and captures the ball in the capturing zone by using the camera corresponding to the infrared sensor of the launch detecting zone at the second time obtained by adding a predetermined time to the first time.

10. The ball launch analysis device according to claim 1, wherein:

when the placement determination control part determines that the ball was placed in either the left trigger zone of the left capturing zone or the left trigger zone of the right capturing zone, the placement determination control part sets a ball launch prediction zone including a ball image and aligned with a launch direction of the ball in the captured image used for the determination, and the calculation control part sets the ball launch prediction zone in the captured image at the first time, performs a predetermined image processing on the ball launch prediction zone, specifies a first ball image, and calculates flight parameters of the ball.

11. A ball launch analysis method of a ball launch analysis device comprising:

left and right infrared sensors being provided on left and right sides of the device respectively, and being capable of detecting a left detecting zone and a right detecting zone respectively, wherein the left detecting zone and the right detecting zone are adjacent to each other and do not overlap;

left and right cameras being provided on the left and right sides of the device respectively, and being capable of capturing a left capturing zone and a right capturing zone including the left detecting zone and the right detecting zone respectively, wherein the left capturing zone and the right capturing zone overlap each other;

a placement determination control step for determining whether or not a ball was placed in either a left trigger zone that is preset within the left detecting zone in the left capturing zone or a right trigger zone that is preset within the right detecting zone in the right capturing zone by using the left and right cameras;

an appearance determination control step for determining whether or not an object appeared in a placement detecting zone including a placement trigger zone by using the infrared sensor corresponding to the camera of the placement trigger zone where the ball was placed when it is determined that the ball was placed in either the left trigger zone or the right trigger zone by the placement determination control step;

a disappearance determination control step for determining whether or not the ball disappeared from the placement detecting zone where the object appeared by using the infrared sensor corresponding to the placement detecting zone when it is determined that the object appeared in the placement detecting zone by the appearance determination control step;

a next appearance determination control step for determining whether or not the ball appeared in a launch detecting zone by using the infrared sensor corresponding to the launch detecting zone adjacent to the placement detecting zone when it is determined that the ball disappeared from the placement detecting zone by the disappearance determination control step;

a signal transmission control step for transmitting a trigger signal when it is determined that the ball appeared in the launch detecting zone by the next appearance determination control step;

a capture control step for capturing the ball continuously in the left capturing zone and the right capturing zone by using the left and right cameras when the trigger signal is transmitted;

a calculation control step for calculating flight parameters of the ball based on ball images of the ball continuously captured by the left and right cameras.

12. The ball launch analysis method according to claim 11, wherein:

the placement determination control step searches whether or not there is a ball image corresponding to the ball as a circular image in the captured image of the left capturing zone or the captured image of the right capturing zone, when the placement determination control step can not search the ball image as a circular image, the placement determination control step determines that the ball was not placed in either the left trigger zone of the left capturing zone or the left trigger zone of the right capturing zone, when the placement determination control step can search the ball image as a circular image, the placement determination control step acquires position information of the trigger zone of the capturing zone where the ball image of the circular image is searched, and determines whether or not the searched ball image is included inside the trigger zone, when the ball image is not included inside the trigger zone, the placement determination control step determines that the ball was not placed in either the left trigger zone of the left capturing zone or the left trigger zone of the right capturing zone, and when the ball image is included inside the trigger zone, the placement determination control step determines that the ball was placed in either the left trigger zone of the left capturing zone or the left trigger zone of the right capturing zone.

13. The ball launch analysis method according to claim 11, further comprising:

a display control step for displaying captured image where the ball was placed on a monitor by using the camera that captures the captured image where it is determined that the ball was placed.

14. The ball launch analysis method according to claim 11, further comprising:

a swing camera capturing a swing zone that overlaps a left capturing zone of the left camera and a right capturing zone of the right camera, and a display control step for activating the swing camera, capturing a swing of the player, and displaying video captured by the swing camera.

15. The ball launch analysis method according to claim 11, wherein:

the appearance determination control step regularly acquires intensity of reflected light in the placement detecting zone of the infrared sensor, and determines whether or not a change of the intensity of the reflected light in the placement detecting zone exceeded a first appearance threshold, when the change of the intensity of the reflected light in the placement detecting zone is within the first appearance threshold, the appearance determination control step determines that an object did not appear in the placement detecting zone, and when the change of the intensity of the reflected light in the placement detecting zone exceeded the first appearance threshold, the appearance determination control step determines that an object appeared in the placement detecting zone.

16. The ball launch analysis method according to claim 11, wherein:

the disappearance determination control step regularly acquires intensity of reflected light in the placement detecting zone of the infrared sensor, and determines whether or not a change of the intensity of the reflected light in the placement detecting zone exceeded a predetermined disappearance threshold, when the change of the intensity of the reflected light in the placement detecting zone is within the disappearance threshold, the disappearance determination control step determines that the ball did not disappear from the placement detecting zone, and when the change of the intensity of the reflected light in the placement detecting zone exceeded the disappearance threshold, the disappearance determination control step determines that the ball disappeared from the placement detecting zone.

17. The ball launch analysis method according to claim 11, wherein:

the next appearance determination control step regularly acquires intensity of reflected light in the launch detecting zone of the infrared sensor, and determines whether or not a change of the intensity of the reflected light in the launch detecting zone exceeded a second appearance threshold, when the change of the intensity of the reflected light in the launch detecting zone is within the second appearance threshold, the appearance determination control step determines that an object did not appeared in the launch detecting zone, and when the change of the intensity of the reflected light in the launch detecting zone exceeded the second appearance threshold, the next appearance determination control step determines that an object appeared in the launch detecting zone.

18. The ball launch analysis method according to claim 11, wherein:

the calculation control step determines whether or not the calculated flight parameters are normal, when the calculated flight parameters are not normal, the calculation control step determines that the launch of the player was unsuccessful, and displays a redo, and when the calculated flight parameters are normal, the calculation control step determines that the launch of the player was successful, and displays the calculated flight parameters.

19. The ball launch analysis method according to claim 11, wherein:

the capture control step captures the ball in the capturing zone by using the camera corresponding to the infrared sensor of the placement detecting zone at the first time immediately after the transmission time of the trigger signal, and captures the ball in the capturing zone by using the camera corresponding to the infrared sensor of the launch detecting zone at the second time obtained by adding a predetermined time to the first time.

20. The ball launch analysis method according to claim 11, wherein:

when the placement determination control step determines that the ball was placed in either the left trigger zone of the left capturing zone or the left trigger zone of the right capturing zone, the placement determination control step sets a ball launch prediction zone including a ball image and aligned with a launch direction of the ball in the captured image used for the determination, and the calculation control step sets the ball launch prediction zone in the captured image at the first time, performs a predetermined image processing on the ball launch prediction zone, specifies a first ball image, and calculates flight parameters of the ball.

* * * * *